US007191836B2

(12) United States Patent
Bhat et al.

(10) Patent No.: US 7,191,836 B2
(45) Date of Patent: Mar. 20, 2007

(54) DRY TREE SUBSEA WELL COMMUNICATIONS APPARATUS AND METHOD USING VARIABLE TENSION LARGE OFFSET RISERS

(75) Inventors: Shankar Uluvana Bhat, Houston, TX (US); John Christian Hartley Mungall, Houston, TX (US); Kevin Gerard Haverty, Houston, TX (US); David Brian Andersen, Houston, TX (US); William Lewis Greiner, Houston, TX (US)

(73) Assignee: Kellogg Brown & Root LLC, Houston, TX (US)

( * ) Notice: Subject to any disclaimer, the term of this patent is extended or adjusted under 35 U.S.C. 154(b) by 375 days.

(21) Appl. No.: 10/710,780

(22) Filed: Aug. 2, 2004

(65) Prior Publication Data

US 2006/0021756 A1 Feb. 2, 2006

(51) Int. Cl.
*E21B 29/12* (2006.01)

(52) U.S. Cl. ..... 166/355; 166/350; 166/367; 405/224.4

(58) Field of Classification Search ..... 166/350, 166/355, 367, 351, 338, 341; 405/224.2–224.4; 114/230
See application file for complete search history.

(56) References Cited

U.S. PATENT DOCUMENTS 3,698,348 A * 10/1972 Morgan ..... 114/245
4,175,890 A * 11/1979 Taylor ..... 405/202
4,185,694 A * 1/1980 Horton ..... 166/350
4,281,614 A * 8/1981 McNary et al. ..... 114/264
4,388,022 A * 6/1983 Gentry et al. ..... 405/224.3
4,478,586 A * 10/1984 Gentry et al. ..... 441/4
4,657,439 A * 4/1987 Petersen ..... 405/200
4,721,053 A * 1/1988 Brewerton ..... 114/230.13
4,730,677 A * 3/1988 Pearce et al. ..... 166/345
4,740,109 A * 4/1988 Horton ..... 405/224.2
5,222,453 A * 6/1993 Chabot ..... 114/230.22
5,778,981 A * 7/1998 Head ..... 166/345
5,846,028 A * 12/1998 Thory ..... 405/195.1
6,062,769 A * 5/2000 Cunningham ..... 405/195.1
6,113,315 A * 9/2000 Fulton et al. ..... 405/224.1
6,276,456 B1 * 8/2001 Head ..... 166/359
6,461,083 B1 * 10/2002 Pionetti et al. ..... 405/224.2
6,682,266 B2 * 1/2004 Karal et al. ..... 405/223.1
6,837,311 B1 * 1/2005 Sele et al. ..... 166/353

OTHER PUBLICATIONS

Norihiko Okamoto, et al., Competitive CVAR-FPSO concepts with Dry Trees in ultra-deepwater, Offshore Technology Conference Paper No. OTC-14001, May 6, 2002, USA.

(Continued)

*Primary Examiner*—Thomas A Beach
(74) *Attorney, Agent, or Firm*—Lundeen & Dickenson, LLP

(57) ABSTRACT

Disclosed are compliant variable tension risers (106) to connect deep-water subsea wellheads (102) to a single floating platform (104). The variable tension risers (106) allow several subsea well-heads (102), in water depths from 4,000 to 10,000 feet, at lateral offsets from one-tenth to one-half of the depth, to tie back to a single floating dry tree semi-submersible platform (104). Also disclosed are methods to counter buoyancy and install variable tension risers using a weighted chain ballast line (228, 230).

39 Claims, 19 Drawing Sheets

OTHER PUBLICATIONS

Kozo Ishida, et al., An FPSO with Surface Wells and Workover System in Deepwater, Offshore Technology Conference Paper No. OTC-12990, Apr. 30, 2001, USA.

Chris Mungall, et al., Semisubmersible Based Dry Tree Platform with Compliant Vertical Access Risers, Offshore Technology Conference Paper No. OTC-16199, May 3, 2004.

Chris Mungall, et al., A Dry Tree Alternative for Ultra-deep Water, Tech Talk KBR Product Technology Newletter, Spring 2004, pp. 4-5, Spring 2004, USA.

Shankar Bhat, Semi-Submersible Based Dry Tree Alternative for Deep to Ultra-Deep Water, KBR product flyer, pp. 1-2, 2004, USA.

* cited by examiner

DRY TREE SUBSEA WELL COMMUNICATIONS APPARATUS AND METHOD USING VARIABLE TENSION LARGE OFFSET RISERS

BACKGROUND OF INVENTION

The present invention generally relates to the production of hydrocarbons from subsea wellheads located in deep to ultra-deep water depths. More particularly, the present invention relates to apparatuses and methods to produce hydrocarbons from a floating platform, supporting a dry tree, connected to subsea wellheads located in deep water depths. More particularly still, the present invention relates to apparatuses and methods using compliant tension risers to hydraulically connect widely dispersed deep-water subsea wellheads to a floating platform supporting a dry tree.

A variety of designs exist for the production of hydrocarbons in deep to ultra-deep waters, i.e. depths greater than 4,000 feet. Generally, the preexisting designs fall within one of two types, namely, wet tree or dry tree systems. These systems are primarily distinguished by the location of pressure and reservoir fluid flow control devices. A wet tree system is characterized by locating the trees atop a wellhead on the seafloor whereas a dry tree system locates the trees on the platform in a dry location. These control devices are used to shut in a producing well as part of a routine operation or, in the event of an abnormal circumstance, as part of an emergency procedure.

In wet tree systems, these control devices are located proximate to a subsea wellhead and are therefore submerged. The primary function of the tree is to shut-in the well, in either an emergency or routine operation, in preparation for workover or other major operations.

Dry tree systems, in contrast, place the control devices on a floating platform out of the water, and are therefore relatively dry in nature. Having the production tree constructed as a dry system allows operational and emergency work to be performed with minimal, if any, ROV assistance and with reduced costs and lead-time. The ability to have direct access to a subsea well from a dry tree is highly economically advantageous. The elimination of the need for a separate support vessel for maintenance operations and the potential for increased well productivity through the frequent performance of such operations are beneficial to well operators. Furthermore, the elimination of a dedicated workover riser and the associated deployment costs will also result in a substantial savings to the operator.

Historically, dry tree systems have been installed in conjunction with tension leg platforms or spar-type platforms that float on the surface over the wellhead and have minimal heave motion impact upon the risers. Generically, a riser extending from a tension leg or spar platform is referred to as a top tensioned riser (TTR) as it is either supported directly by the host platform or hull support, or independently by air cans that supply tension to the upper portion. In the case of hull supported TTRs, top tension is supplied via a system of tensioning devices, wherein sufficient tension is applied such that the top tensioned risers remain in tension for all loading conditions. The relative motion between TTRs and the platform in a hull support arrangement is typically accommodated through a stroke biasing action of the tension devices themselves. Therefore, on a spar or tension leg platform, relative movements of the floating platform will be transmitted only minimally through the riser systems because equipment aboard the platform will give and take to accommodate those movements. Particularly, with TTRs, the tension is applied at the top and the tension decreases in a substantially linear profile with depth to the subsea wellhead.

In contrast, vertical riser loads for air can supported TTRs are not carried by the hull of a platform. Instead, the air can supported TTRs ascend from subsea wellheads through an aperture in the work deck known as a moonpool. The TTRs extend through the moonpool and connect to dry trees located on the tops of aircans in the bay area of the platform. Using this construction, each air can supported TTR is permitted to move vertically relative to the hull of the platform through the moonpool. This vertical movement of the TTR relative to the platform is a function of the magnitude of platform offset and set-down, first-order vessel motions, air can area and friction forces between the hull structure and the air cans. The fluid path between the dry tree on the aircan and the processing facility on the vessel is usually accomplished by means of a non-bonded flexible jumper.

Regardless of particular configuration, the tension within a TTR system creates a characteristic shape that is substantially linear and in a near vertical configuration. Since TTR curvatures and capabilities for compliance are relatively small, multiple subsea wells connected to a single tension leg or spar platform by TTR'" are required to be closely spaced to one another on the ocean floor. Typically, the maximum distance between the most remote subsea wells in a cluster to be serviced by a single platform via TTRs is 300 feet. Therefore, dry tree platforms, as deployed with currently available technology, require relatively closely spaced subsea wells in order to be feasible. Unfortunately, the placement of subsea wellheads within 300 feet of each other is not always feasible or economically desirable. Changes in locations and types of undersea geological formations often dictate that wellheads be spaced apart at distances greatly exceeding 300 feet. In these instances, it is often less economically feasible to employ dry tree strategies to service these wells as their spacing would require the installation of several tension leg or spar platforms. In these circumstances, wet tree schemes have typically been used.

A dry tree platform system capable of servicing clusters of subsea wellheads at greater spacing distances would offer practical, economic and other advantages. Furthermore, alternatives to tension leg and spar platforms would also be desirable to those in the field of offshore well servicing. Tension leg and spar platforms are relatively expensive endeavors, particularly because of the amount of anchoring and mooring required to maintain them in a relatively static position in rough waters. A platform system having a dry tree arrangement and utilizing a less restrictive and less costly mooring system would be well received by the industry. The present invention addresses these and other inadequacies of the prior art.

SUMMARY OF INVENTION

The present invention can provide dry tree functionality to host production facilities with increased motion characteristics relative to spar or tension leg platforms. Such host productions can now be constructed using semi-submersible or mono-hulled platforms including, but not limited to, floating production storage and offloading (FPSO) platforms. Embodiments of the present invention include compliant production riser systems that can accommodate well service and maintenance activities. Embodiments of the present invention are directed to the tieback of subsea wells distantly spaced to a single host production facility having a dry tree.

In one embodiment, an apparatus to communicate with a plurality of subsea wells located at a depth from the surface of a body of water can include a floating platform having a dry tree apparatus configured to communicate with and service the subsea wells. The apparatus can also include a plurality of variable tension risers wherein each of the risers can be configured to extend from one of the wells to the floating platform. The variable tension risers can have a negatively buoyant region, a positively buoyant region, and a neutrally buoyant region between the negatively and positively buoyant regions. The negatively buoyant region is hung from the floating platform and exhibits positive tension. The neutrally buoyant region is characterized by a curved geometry configured to traverse a lateral offset of at least 300 feet between the floating platform and the subsea well. The positively buoyant region can be positioned above the subsea well and exhibits positive tension.

The apparatus can be used in water of a sufficient depth to accommodate the curved geometry, e.g. 1,000 feet, but will have particular applicability in a depth of water greater than 4,000 feet. The apparatus can be used in water having depths of up to 10,000 or 15,000 feet, or more. The plurality of subsea wells can be characterized by a maximum offset, wherein the offset defines the maximum distance on a sea floor of the body of water between the dry tree apparatus and a most distant well of the plurality of subsea wells. The maximum offset can be less than or equal to one half the depth or greater than or equal to one tenth the depth from the surface of the body of water. The plurality of subsea wells can include vertically drilled wells, and can be free of slant and horizontally or partially horizontally drilled wells. The apparatus can include a floating platform that is a spar platform, a tension leg platform, a submersible platform, a semi-submersible platform, well intervention platform, drillship, dedicated floating production facility, and so on.

The variable tension risers can terminate at the dry tree, a distal end, or a pontoon of the floating platform. A spool connection can connect a variable tension riser not terminated at the dry tree to the dry tree. A second neutral buoyancy region proximate to a distal end of the floating platform can be included. The variable tension risers can include a rope and ballast line attachment point or a stress joint proximate to a connection with the subsea well or to the floating platform.

The apparatus can include a spacer ring configured to make a connection between the neutral buoyancy region and the negatively buoyant region of each variable tension riser. The spacer ring can be configured to restrict relative lateral movement and allow relative axial movement of the variable tension risers. The apparatus can include anchor lines connecting the variable tension risers to a seafloor below the body of water wherein the anchor lines are configured to restrict movement of the variable tension risers. The variable tension risers can include single, coaxial, or multi-axial conduits to communicate with, produce from, or perform work on the subsea well connected to the variable tension riser. Furthermore, each variable tension riser can optionally include a second negatively buoyant region between the positively buoyant region and the subsea well with positive tension in the riser proximate the subsea well.

In another aspect, a method to install a communications riser from a floating platform to a subsea wellhead can include deploying a wellhead connector mounted on a distal end of a first slick section of the communications riser from the floating platform. The method can include attaching a guide and ballast line to a connection to the communications riser, wherein the guide and ballast line are configured to be paid out and taken up from a floating vessel. The method can include deploying a buoyed section of the riser from the floating platform and adjusting the guide and ballast line to counter any positive buoyancy of the buoyed section. The method can include deploying a neutrally buoyant section of the riser from the floating platform. Finally, the method can include manipulating the guide and ballast line with the floating vessel to deflect the communications riser a lateral distance, and lowering the communications riser to engage the wellhead with the wellhead connector.

If desired, the method can include creating a curved section of the communications riser in the neutrally buoyant section of the riser to traverse the lateral distance. Optionally, the guide and ballast line can comprise a heavy ballast chain, such as, for example, a 6-inch stud-link chain weighing over 200 pounds per foot of length. The guide and ballast line can comprise a fine-tuning ballast chain, such as, for example, a 3-inch stud-link chain weighing less than 100 pounds per foot of length. Optionally, the method can include paying out and taking up the guide and ballast line to apply axial and lateral loads to guide the communications riser across the lateral distance. The method can also include using remotely operated vehicles to assist in the deflection of the communications riser.

The communications riser can be a variable tension riser. The method can include deploying a transition section of the riser from the floating platform. The neutrally buoyant section of the communications riser can include a heavy case section or a light case section. The floating platform can be a semi-submersible platform. The method can include deploying a plurality of communications risers from the floating platform. The subsea wellhead can be located in water of any sufficient depth below the floating platform, e.g. 1,000 feet, but will have particular applicability in a depth of water greater than 4,000 feet below the floating platform. The subsea wellhead can be located in water having depths of up to 10,000 or 15,000 feet, or more.

In another embodiment, a variable tension riser connects a subsea wellhead to a floating platform and traverses a lateral offset of at least 300 feet. The variable tension riser can include a first negatively buoyant region, a neutrally buoyant curved region, a positively buoyant region, and a second negatively buoyant region. The first negatively buoyant region hangs below the floating platform exhibiting positive tension. The second negatively buoyant region is positioned above the subsea wellhead. The neutrally buoyant curved region is located between the first negatively buoyant region and the positively buoyant region, which is located above the second negatively buoyant region to create positive tension within the second negatively buoyant region. The variable tension riser can include a communications conduit to allow communications from the floating platform to a wellbore of the subsea wellhead.

The curved region can traverse the lateral offset between the subsea wellhead and the floating platform. The subsea wellhead can be located in water of a sufficient depth to accommodate the curved geometry, e.g. 1,000 feet, but the variable tension riser will have particular applicability in a depth of water greater than 4,000 feet below the floating platform. The variable tension riser can be used in water having depths of up to 10,000 or 15,000 feet, or more. The lateral offset can be less than or equal to one half of the depth of the subsea wellhead below the floating platform and more than one tenth of the depth. Furthermore, the variable tension riser can optionally include a second neutrally buoyant region proximate to the floating platform. The variable tension riser can include a stress joint proximate to the subsea wellhead. The communications conduit can allow for the communication with, production from, and the performance of work on the subsea wellhead from the floating platform. The variable tension riser can further include an anchor line extending to a seafloor mooring configured to restrict movement of the variable tension riser. The variable tension riser can further include a linking member connecting the variable tension riser to a second variable tension riser. Finally, the positively buoyant region can have a positive tension.

BRIEF DESCRIPTION OF DRAWINGS

For a more detailed description of the illustrated embodiments of the present invention, reference will now be made to the accompanying drawings, wherein.

DETAILED DESCRIPTION

Figure 1:
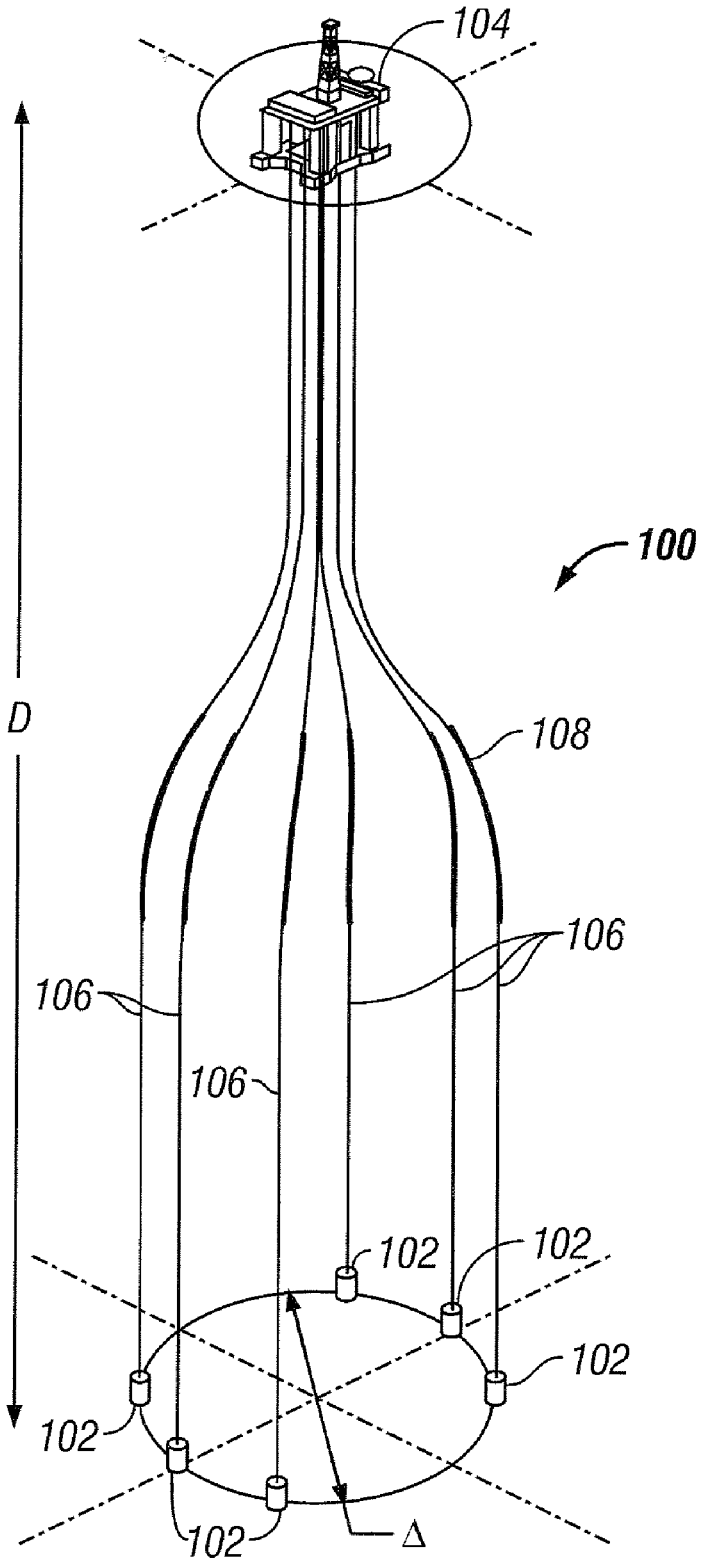
FIG. 1 is anisometric view drawing of a deepwater field development facility in accordance with one embodiment of the present invention.

Referring initially to FIG. 1, a subsea well management system 100 is shown. Management system 100 can include a plurality of subsea wellheads 102 connected to a floating platform 104 through a plurality of variable tension risers 106. Subsea management system 100 can be designed and constructed to function in deepwater environments wherein the total water depth is greater than or equal to 1,000 feet, but will have particular applicability at depths greater than or equal to 4,000 feet up to 10,000 or 15,000 feet, or more. Desirably, for the system 100 shown in FIG. 1, the water depth D between platform 104 and wellheads 102 should be between 5,000 to 10,000 feet.

Variable tension risers 106 can be constructed as lengths of rigid pipe that become relatively compliant when extended over long lengths. For instance, while the materials of variable tension risers 106 may seem highly rigid at short lengths, e.g. 100 feet, they become highly flexible over longer lengths, e.g. from 5,000 to 10,000 feet. The variable tension risers 106 can include various regions of differing buoyancy relative to the seawater in which they reside. Neutral buoyancy regions 108 can be located along the length of variable tension risers 106 to assist in forming and maintaining the s-curve thereof shown in FIG. 1. Neutral buoyancy regions 108 combined with the relative compliance of variable tension risers 106 create a riser extending from subsea wellheads 102 to platform 104 with more lateral and vertical give than with risers available in the prior art.

Furthermore, because servicing each subsea wellhead 102 with its own platform 104 would be economically infeasible, subsea management system 100 is capable of servicing multiple wellheads 102 with a single floating platform 104 and numerous variable tension risers 106. Formerly, the rigid nature of vertical risers and the mooring and anchoring demands of the servicing platforms required that wellheads be located relatively close to one another for them to be serviceable with a single platform. Often, decisions regarding the type, depth, and number of subsea wells were dictated by these design constraints. These constraints often limit the exploration and production of subsea reservoirs because they dictate where wells must be located rather than allow placement more favorable to the efficient exploitation of the trapped hydrocarbons.

Referring still to FIG. 1, subsea wellheads 102 are shown located a within a circle generally having a diameter of Δ. This diameter Δ characterizes a vessel watch circle, wherein the maximum offset from the center of the circle would be the radius or one half of the diameter Δ. The value of Δ will be the largest distance between any two wellheads 102 within the group and represents the amount of spacing generally within a group of subsea wellheads 102. Formerly, using pre-existing technology, wellhead offsets only less than or equal to 10% of the water depth D were feasible. Using systems (e.g. 100 of FIG. 1) in accordance with the present invention, wellhead off-sets from 25% to 50% of the water depth D are feasible. This broader and more dispersed spacing for wellheads 102 allows a subsea geological formation to be more thoroughly and effectively explored. Using systems of the present invention, wells no longer need to be drilled and serviced by a single platform. Instead, a drill ship can drill production wells throughout the field that can all be tied back to a single floating platform for production and maintenance.

Figure 2:
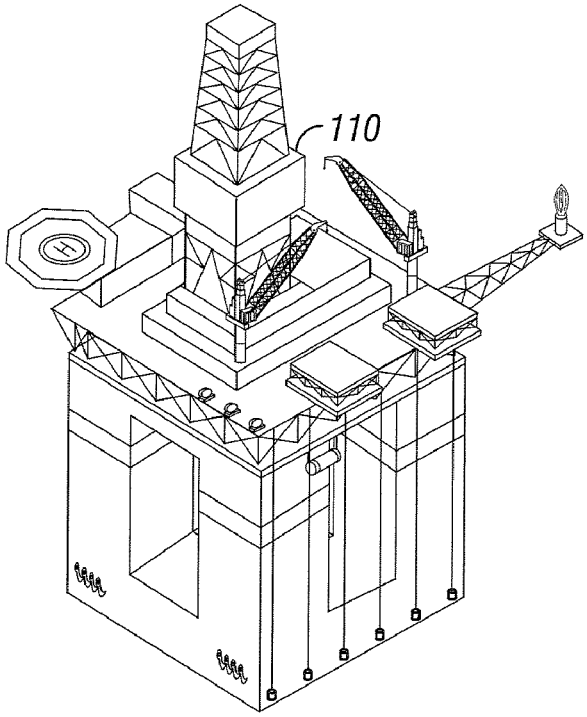
FIG. 2 is an isometric view sketch of a semi-submersible floating production facility used in conjunction with one embodiment of the present invention.
Figure 3:
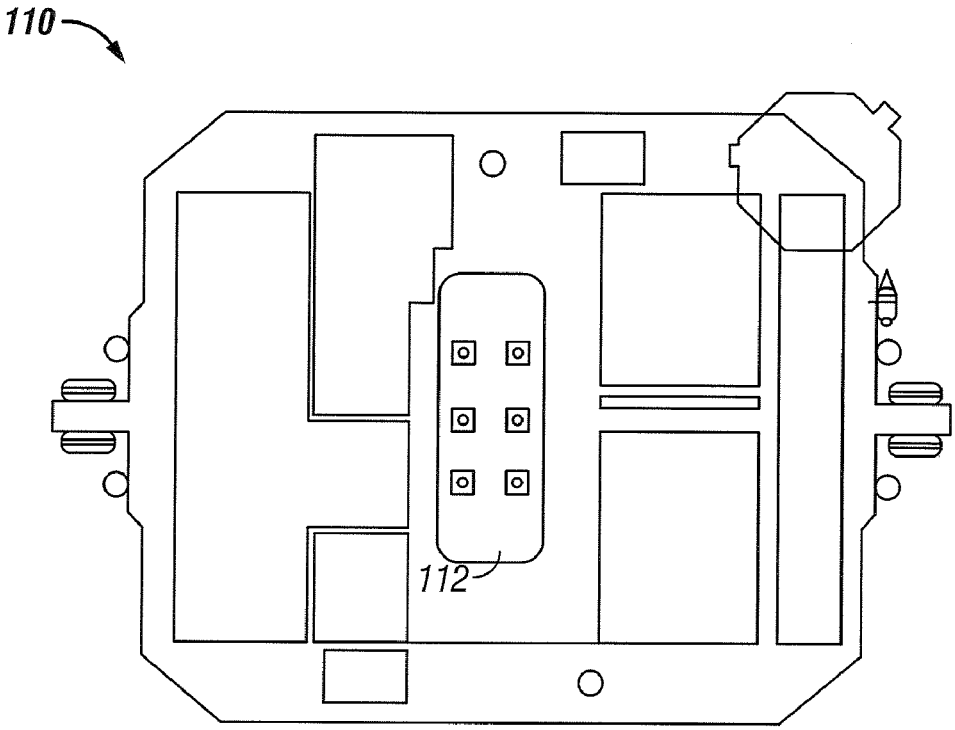
FIG. 3 is top view drawing of the semi-submersible floating production facility of FIG. 2.

Referring briefly to FIGS. 2 and 3, a semi-submersible platform 110 for use with the present invention is shown. Semi-submersible platform is capable of being used as the floating platform 104 of FIG. 1 to service and maintain a plurality of subsea wellheads 102 through variable tension risers 106. Formerly, semi-submersible platforms 110 were not useable with deepwater dry tree production systems because they are not easily maintainable in a position stationary enough to be used with top tensioned risers. Therefore, the displacements and heaving experienced by a semi-submersible platform 110 were not considered feasible. A dry tree assembly 112 located upon a semi-submersible platform 110 will be able to service multiple deep water wellheads 102 without significant concern for maintaining the semi-submersible 110 in an absolute position. Additionally, special purpose floating platforms may also be used for platform 104 to communicate a dry tree assembly 112 with subsea wellheads.

Figure 4A:
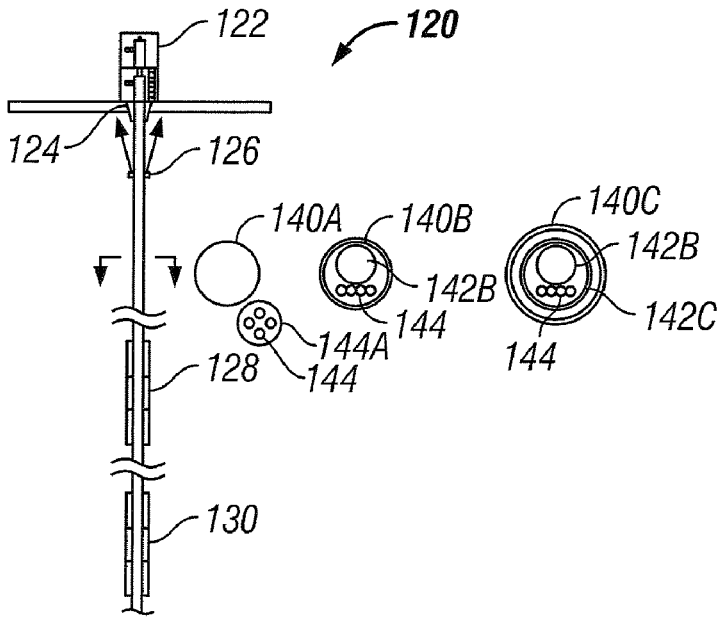
FIGS. 4A and 4B are a schematic side view drawing of a variable tension riser in accordance with one embodiment of the present invention.
Figure 4B:
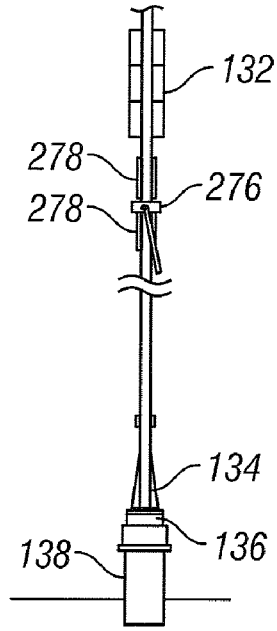

Referring now to FIGS. 4A–4B a variable tension riser 120 in accordance with an embodiment of the present invention is shown. FIG. 4A details the upper portion of variable tension riser 120 from a surface tree 122 on the floating platform to a middle buoyancy region 130, and FIG. 4B the lower portion extending from a bottom buoyancy region 132 to the subsea wellhead 138. Variable tension riser 120 can be constructed extending from a surface tree 122, to a flex joint 124, an optional tension ring 126, a top buoyant region 128, the middle buoyant region 130, the bottom buoyant region 132, a stress joint 134, a tieback connector 136, and to the wellhead 138. Variable tension riser 120 can be constructed from slick joints that include: (a) a tubing riser comprising a single string of production tubing 140A, which can also include control lines 144 in an umbilical 144A wrapped around the tubing 140A; (b) a single casing riser comprising a string of casing 140B that houses at least one string of production tubing 142B and various control lines 144; (c) a dual casing riser comprising a string of outer casing 140C, inner casing 142C, one or more production tubing strings 142B and control lines 144, or any combination of these configurations can be used for various ones of the variable tension riser 120. Variable tension riser 120 can also include an artificial lift system, such as, for example, electric or hydraulic pumps, gas lift or the like. Also, subsea shear rams or other blowout preventers can be provided proximate the connection to the subsea well. Artificial lift systems and blowout prevention devices are well known in the art.

By carefully selecting the configuration and design for buoyancy regions 128, 130, and 132, the variable tension riser 120 can be positioned in an s-curved shape that involves varying amounts of tension throughout its length. Principally, tension in variable tension riser 120 will be greatest at flex joint 124 near the floating platform and just below lowermost buoyancy region 132 at the top of the lower slick pipe region above wellhead 138, due to the weight of the negatively buoyant riser hanging below these points. Tension decreases linearly from these points, generally to about neutral at the buoyancy region 128 but desirably remains above zero or positive at the wellhead 138. Stress joints 124, 134 are used to accommodate lateral displacements of the variable tension riser 120 in these high tensile locations. At all points in between, tension can be varied through the use of buoyancy regions 128, 130, and 132 and through the use of ballast and weighting chains (not shown) attached to attachment point 276 and stress relief sub 278 (discussed in detail below in relation to FIG. 23).

Figure 5:
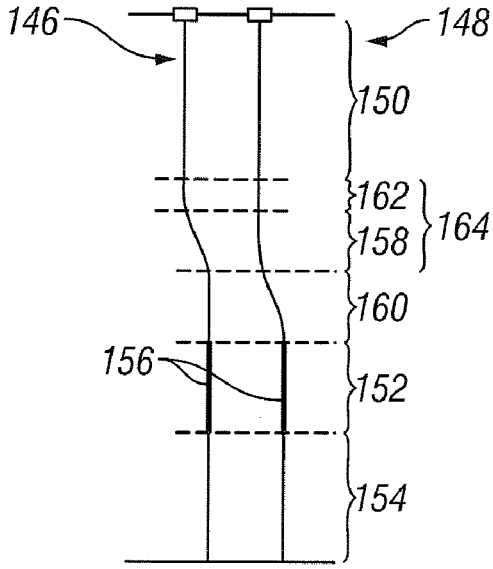
FIG. 5 is a schematic side view drawing of a variable tension riser showing buoyancy regions in accordance with an embodiment of the present invention.

Referring to FIG. 5, the buoyancy regions for two different variable tension risers 146, 148 are shown. Variable tension riser 146 is shown schematically as a light case where the fluid density in the riser string is relatively low and the and the weight of the riser is string is thus less than the heavy case variable tension riser shown by item 148 representing a relatively high fluid density. In the heavy case the Generally, the wall thickness and weight of variable tension riser 146, 148 can be designed using various parameters including the overall length of variable tension riser 146, 148, how much curvature is desired, i.e. the wellhead spacing, and the expected inside and outside pressure conditions.

Referring to light case 146 and heavy case 148 variable tension riser strings together, various buoyancy regions are shown in common. First, a top slick pipe region 150 is present at the uppermost section of risers 146, 148. Top region 150 experiences tension as it extends down from the floating platform located on the water surface. The weight of the pipe in the top region 150 creates this tensile condition. Next, a bottom buoyancy region 152 creates tensile conditions within lower portions 154 of variable tension risers 146, 148 extending from wellheads on the seabed. Particularly, buoyancy devices known to one skilled in the art, shown schematically at 156, are placed upon risers 146, 148 to counteract the weight of the slick pipe of risers 146, 148 and upwardly buoy sections 154. This results in a positively tensioned region 154 for variable tension risers 146, 148.

Next, neutrally buoyant and transitional regions exist along the length of risers 146, 148 somewhere between region 150 and regions 152, 154, due to the negative buoyancy at region 150 and positive buoyancy at region 152. As the loading conditions within risers 146 and 148 range from negative buoyancy to positive buoyancy, the laws of physics dictate that there must be a zero or neutrally buoyant portion somewhere between the differently tensioned regions. For light case variable tension riser 146, the neutral buoyancy region is indicated at 158. For heavy case variable tension riser 148, the neutral buoyancy region is indicated at 160. Furthermore, transitional regions 162, 164 exist between tensile region 150 and respective neutrally buoyant regions 158, 160.

Figure 6:
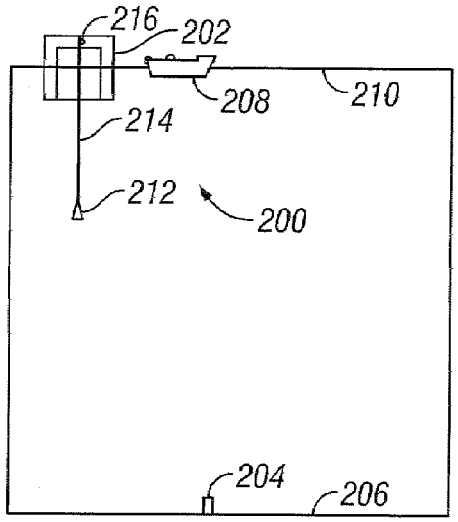
FIGS. 6–22 are schematic side view drawings showing the steps to install a variable tension riser from a floating production facility in accordance with an embodiment of the present invention.
Figure 7:
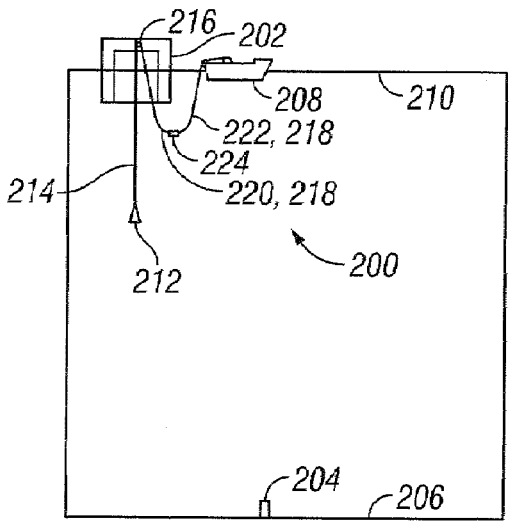

Referring collectively to FIGS. 6–22, an installation process for a variable tension riser assembly 200 is depicted. Referring initially to FIG. 6, a variable tension riser assembly 200 is shown being run from a floating work facility 202 to a wellhead 204 on the ocean floor 206. A workboat 208 is available on the surface 210 of the water to assist in the installation process, if necessary. At this point, variable tension riser 200 includes a stress joint 212, a length of slick pipe 214, and a ballast line attachment point 216. Referring now to FIG. 7, a tension line or rope 218 is connected from the workboat 208 to ballast line attachment point 216. Rope 218 can be a keel-haul synthetic line rope, such as, for example, 6-inch diameter polyester, but may be of any style and type known to one of ordinary skill in the art. Optionally, rope 218 can be constructed as multiple sections, for example, the two segments 220, 222 as shown, having a connector 224 between the adjacent segments, which can also help weight down rope 218.

Figure 8:
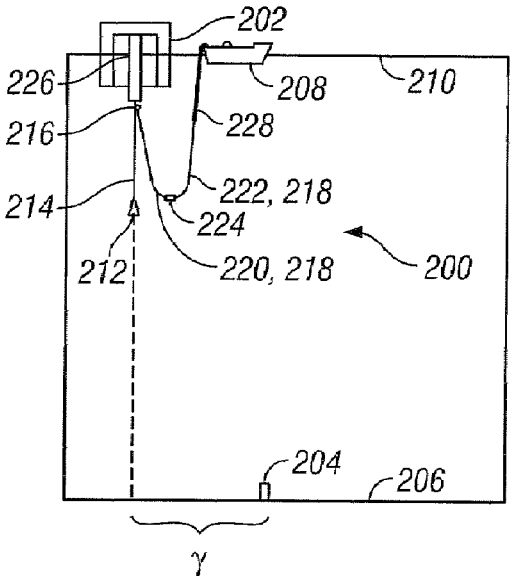

Referring now to FIG. 8, variable tension riser 200 continues to be deployed from floating platform 202 towards wellhead 204. Following deployment of the lower section of slick pipe 214, the lower buoyancy region 226 is deployed. As buoyancy region 226 is deployed, main ballast chain 228 is paid out from workboat 208. Ballast chain 228 can be, for example, a 6-inch stud link chain approximately 650 feet long and weighing about 180,000 pounds in water. Ballast chain 228 is connected to the end of rope line 218 and serves to both ballast and direct the position of variable tension riser assembly 200, offsetting the buoyancy of section 226 and thereby enabling variable tension riser assembly 200 to be sunk into position atop wellhead 204. In addition to providing downward force, ballast chain 228 also provides lateral force to help displace variable tension riser assembly 200 a distance γ from the position of platform 202 to wellhead 204. This lateral deflection is accomplished through the manipulation of ballast chain 228 and rope line 218 from workboat 208. By selectively adjusting the tension and amount of line paid out, workboat 208 can adjust the amount of lateral load on variable tension riser 200 and deflect it into the desired shape as it is deployed.

Figure 9:
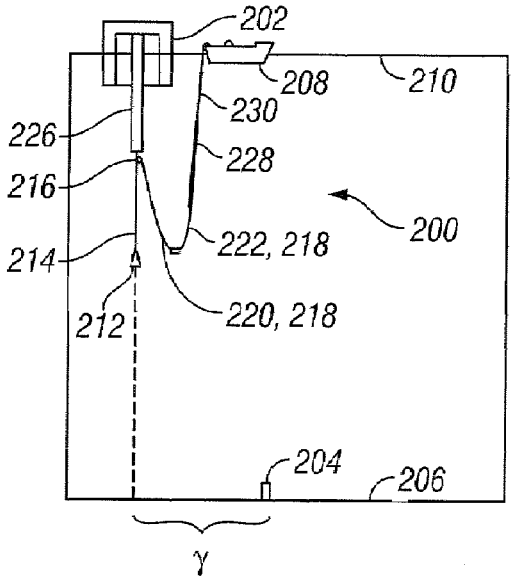

Referring now to FIG. 9, a fine tuning ballast chain 230 is deployed as more of buoyancy region 226 is deployed from floating platform 202. Fine tuning ballast chain 230 can be, for example, a 3-inch stud-link chain approximately 500 feet long and weighing 40,000 pounds in water. Because of the smaller weight than main ballast chain 228, fine-tuning chain 230 allows more precise adjustments in deflection □ to be accomplished by workboat 208. The more accurately workboat 208 can make the positioning and deflection of variable tension riser assembly 200, the less assistance from remotely operated vehicles (ROVs) that is necessary. Furthermore, while specified sizes, weights, and lengths for ballast chains 228, 230 are given, it should be understood by one of ordinary skill in the art that the exact sizes, lengths, and weights depend on the amount of deflection □ needed, the total depth of water traversed, and the construction and material properties of the variable tension riser assembly 200 itself.

Figure 10:
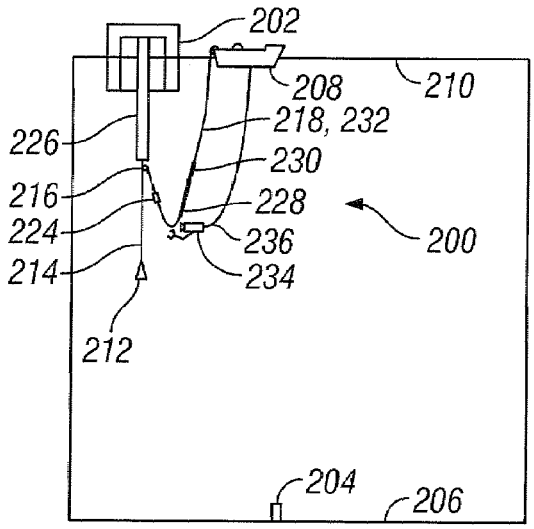
Figure 11:
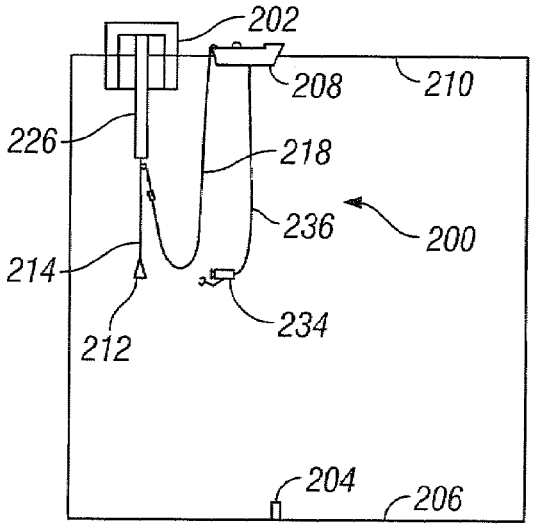

Referring now to FIG. 10, the installation and deployment of variable tension riser assembly 200 continues. As buoyant section 226 continues to be paid out, ballast chains 228 and 230 are paid out until their entire lengths are deployed, at which time another section 232 of rope line 218 is paid out from workboat 208. Furthermore, as seen, ROV 234 can be deployed to assist in the guidance of variable tension riser assembly 200 toward its target wellhead 204. A communications line 236 connects ROV 234 to workboat 208 so that an operator can manipulate and control ROV 234. FIG. 10 details an example of the step where the ballast weight from chains 228 and 230 is still being paid out, while keeping the lateral load upon variable tension riser assembly 200 to a minimum. Referring to FIG. 11, the ballast chains 228, 230 are shown fully deployed upon rope line 218 so as to continue to sink ballast sections 226 deeper into the water.

Figure 12:
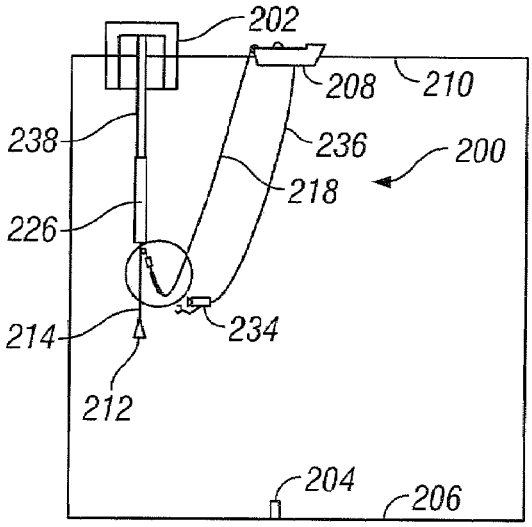
Figure 12A:
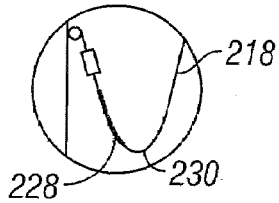

Referring now to FIG. 12, a heavy case neutral buoyancy region 238 is deployed from floating platform 202 atop buoyancy section 226. As can be seen in FIG. 12A, the amount of rope line 218 paid out or taken in by workboat 208 can be used to determine how much weight from ballast chains 228, 230 acts on variable tension riser assembly. Having too much or too little downward ballast force on riser assembly 200 can cause the riser to be too heavy or too buoyant to facilitate deployment.

Figure 13:
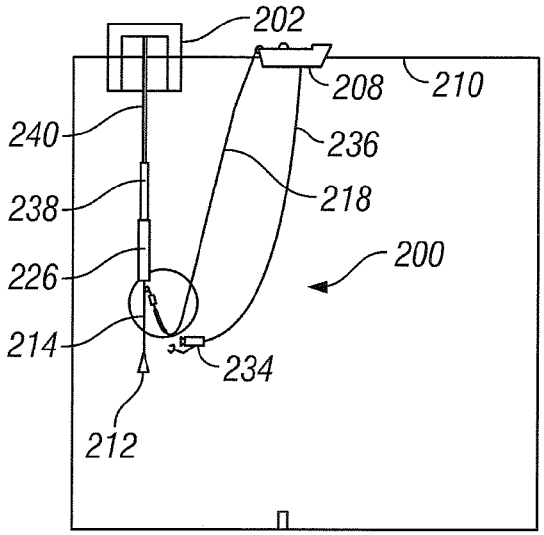

Referring to FIG. 13, a light case neutrally buoyant region 240 is paid out from floating platform 202. Like heavy case region 238 deployed in FIG. 12, light case region 240 does not require much, if any, manipulation of ballast chains 228, 230 as the neutrally buoyant characteristics of the casing does not add significant weight to the variable tension riser assembly 200 in the water.

Figure 14:
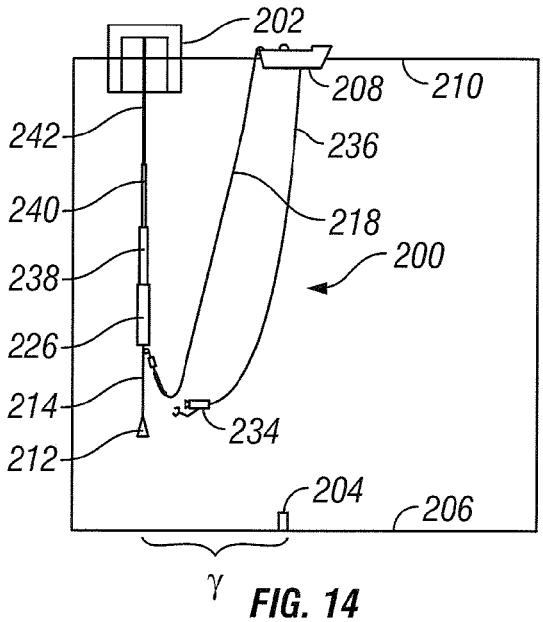

Referring to FIG. 14, a buoyancy transition region 242 is paid out from floating platform 202 while ballast 228, 230 is adjusted and maintained by workboat 208. As before, an ROV is able to assist with fine-tuning of the ballast amount and the directing of variable tension riser assembly 200. As before, variable tension riser assembly 200 is still deployed substantially vertically from floating platform so that deflection distance □ is still present.

Figure 15:
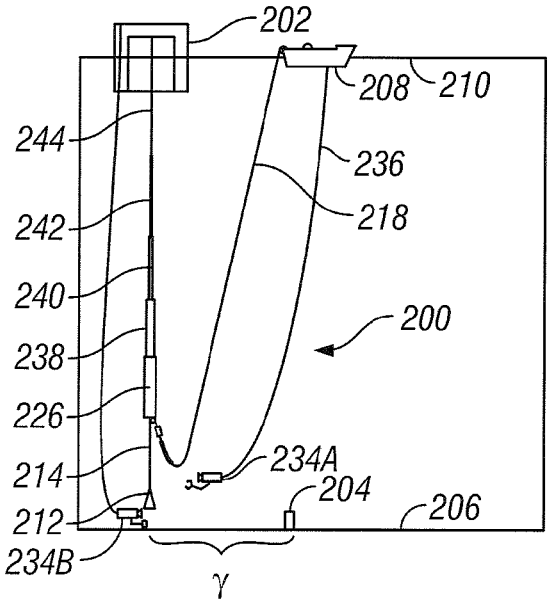

Referring to FIG. 15, an upper length of slick pipe 244 is lowered from floating platform 202. At this point, a second ROV 234B can be deployed to assist first ROV 234A in the manipulation and direction of variable tension riser assembly 200 and ballast line 218, including chains 228 and 230. As before, variable tension riser assembly 200 is deployed from floating platform 202 substantially vertical, being offset from wellhead 204 at ocean floor 206 by a deflection distance □. In FIG. 15, the variable tension riser assembly 200 is deployed enough such that stress joint and wellhead connector 212 is at approximately the same depth as wellhead 204, separated only by deflection distance □.

Figure 16:
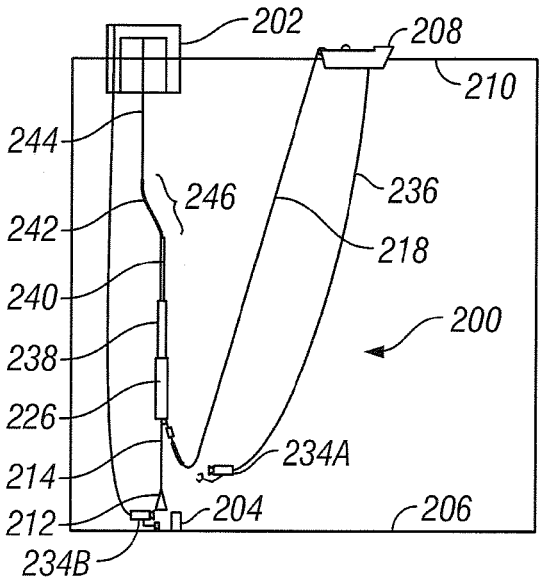

Referring to FIG. 16, the lateral traversal of variable tension riser assembly 200 is undertaken. Workboat 208, through traversal across ocean surface 210 and through selectively paying out and taking up rope line 218 is able to laterally load variable tension riser assembly 200 to the lower end thereof toward wellhead 204 at ocean bottom. Furthermore, ROVs 234A, 234B provide thrusting and direction assistance to direct stress joint 212 at the end of variable tension riser assembly 200 to wellhead. During this displacement, transitional region 242 of variable tension riser assembly 200 begins to form an s-curve region 246 to accommodate the lateral translation thereof. Slick pipe 244 is paid out from floating platform 202 to accommodate in the transitional region 242 any reduction in overall length of variable tension riser 200 resulting from the creation of the s-curve region 246.

Figure 17:
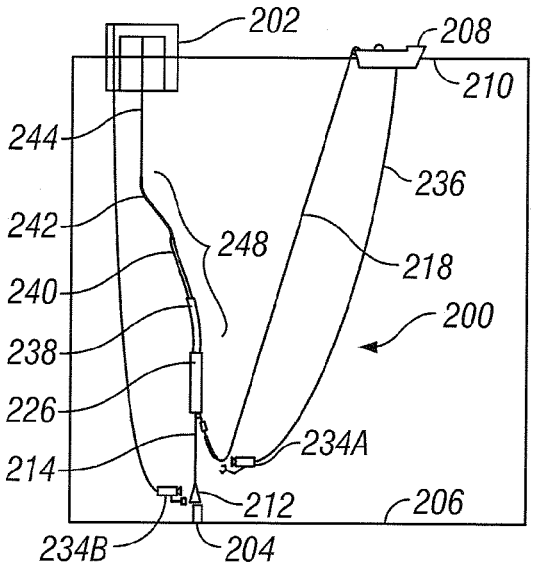

Referring to FIG. 17, the lateral translation of variable tension riser assembly 200 from a position under floating platform 202 to wellhead 204 proceeds with further assistance and direction from ROVs 234A, 234B, and workboat 208 and ballast line 218 (including chains 228, 230). As workboat 208 and ROVs 234A, 234B work together to direct stress joint 212 of variable tension riser assembly 200 toward wellhead 204, the s-curve begins to extend from the transitional section 242, to the light and heavy case sections 240, 238 to form a larger, more graduated s-curve region 248. As before, slick line 244 is paid out from floating platform 202 as needed to maintain the depth of the lower end of the variable tension riser 200.

Figure 18:
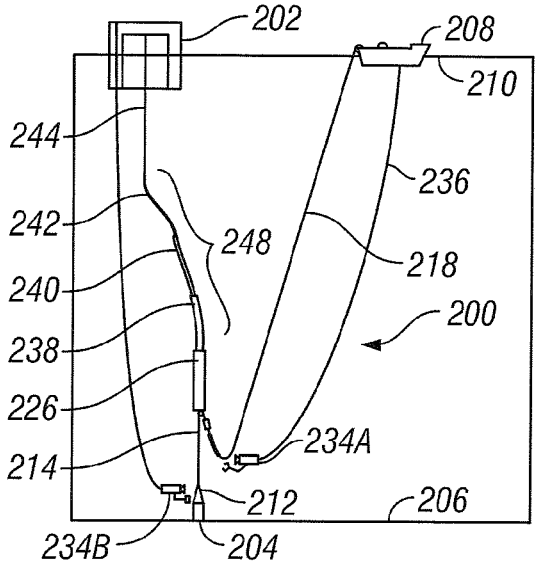

Referring now to FIG. 18, with the stress joint 212 of the variable tension riser assembly 200 properly positioned over wellhead 204, the topmost section of slick pipe 244 is lowered from floating platform 202 to allow a conventional wellhead connector (not shown), such as, for example a collet connector, at a distal end of stress joint 212 to engage with a corresponding socket at the top of wellhead 204. While slick pipe 244 is lowered from floating platform, ROVs 234A, 234B, in conjunction with workboat 208 and ballast line 218, assist in guiding the wellhead connector of variable tension riser assembly 200 into engagement with wellhead 204.

Figure 19:
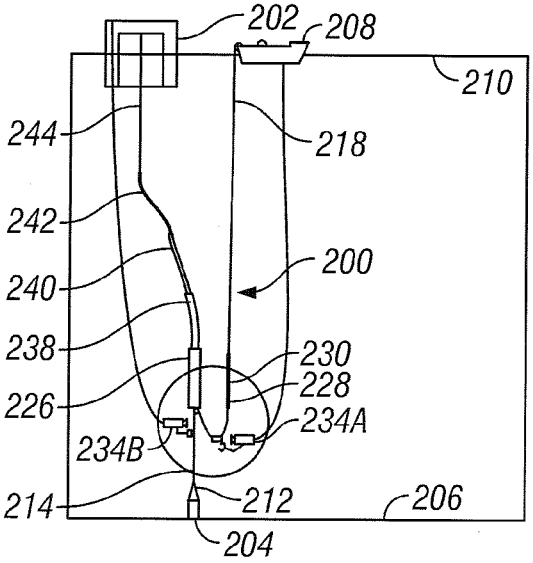
Figure 19A:
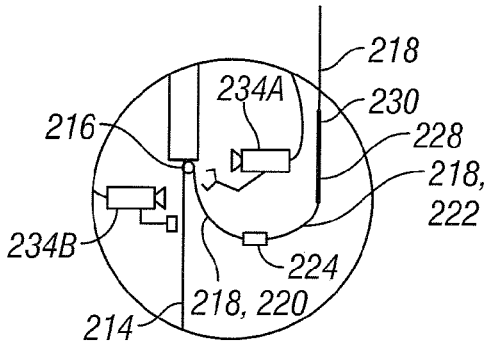
Figure 20:
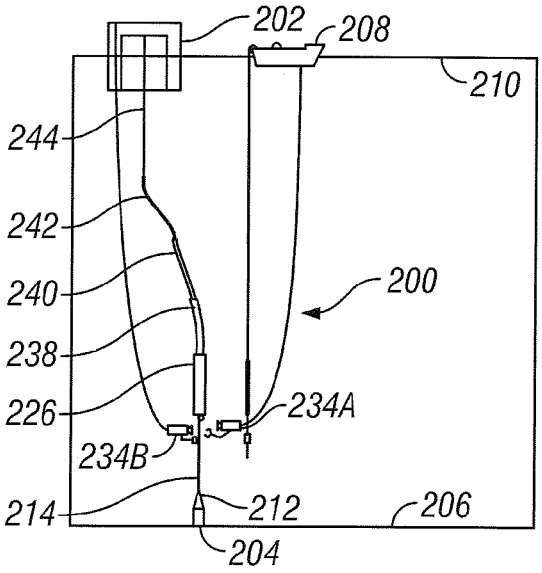
Figure 21:
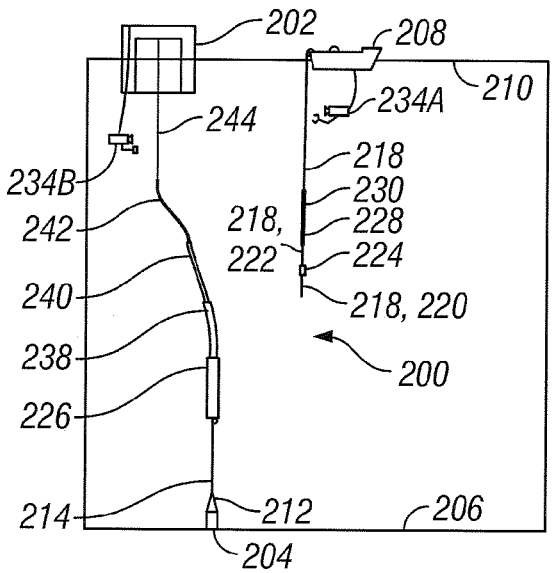

Referring to FIG. 19, workboat 208 positions itself over wellhead 204 and takes in ballast line 218 with attached ballast chains 228, 230. While ROVs 234A, 234B monitor the connection of ballast line 218 with variable tension riser assembly 200, workboat 208 takes in enough of ballast line 218 to remove the weight from chains 228, 230 from riser assembly 200. With the weight of ballast chains 228, 230 removed, buoyant section 226 of variable tension riser assembly is free to act upon slick pipe section 214 and wellhead connector 204, thereby placing the portion of variable tension riser assembly in tension, as designed.

Figure 22:
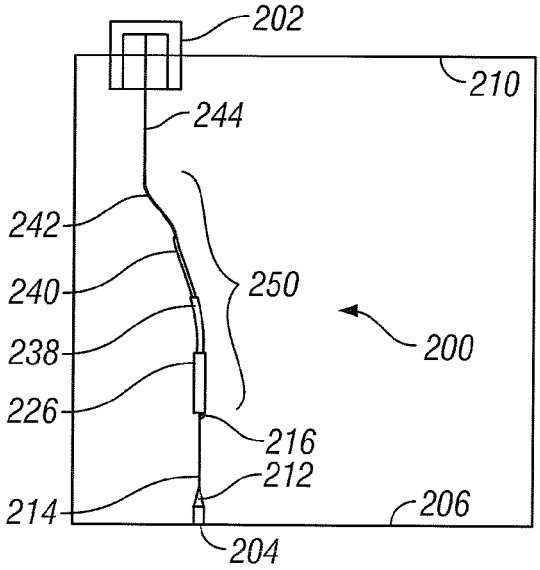

Referring to FIGS. 19A through 21, ROVs 234A, 234B disconnect rope ballast line 218 with attached chains 228, 230 from attachment point 216 so that it may be retrieved by a winch mounted aboard workboat 208. Referring briefly to FIG. 22, tension in top slick pipe section 244 is adjusted to its final value, resulting in a final desired s-curve geometry 250 for sections 238, 240, and 242 of variable tension riser assembly 200.

Figure 23:
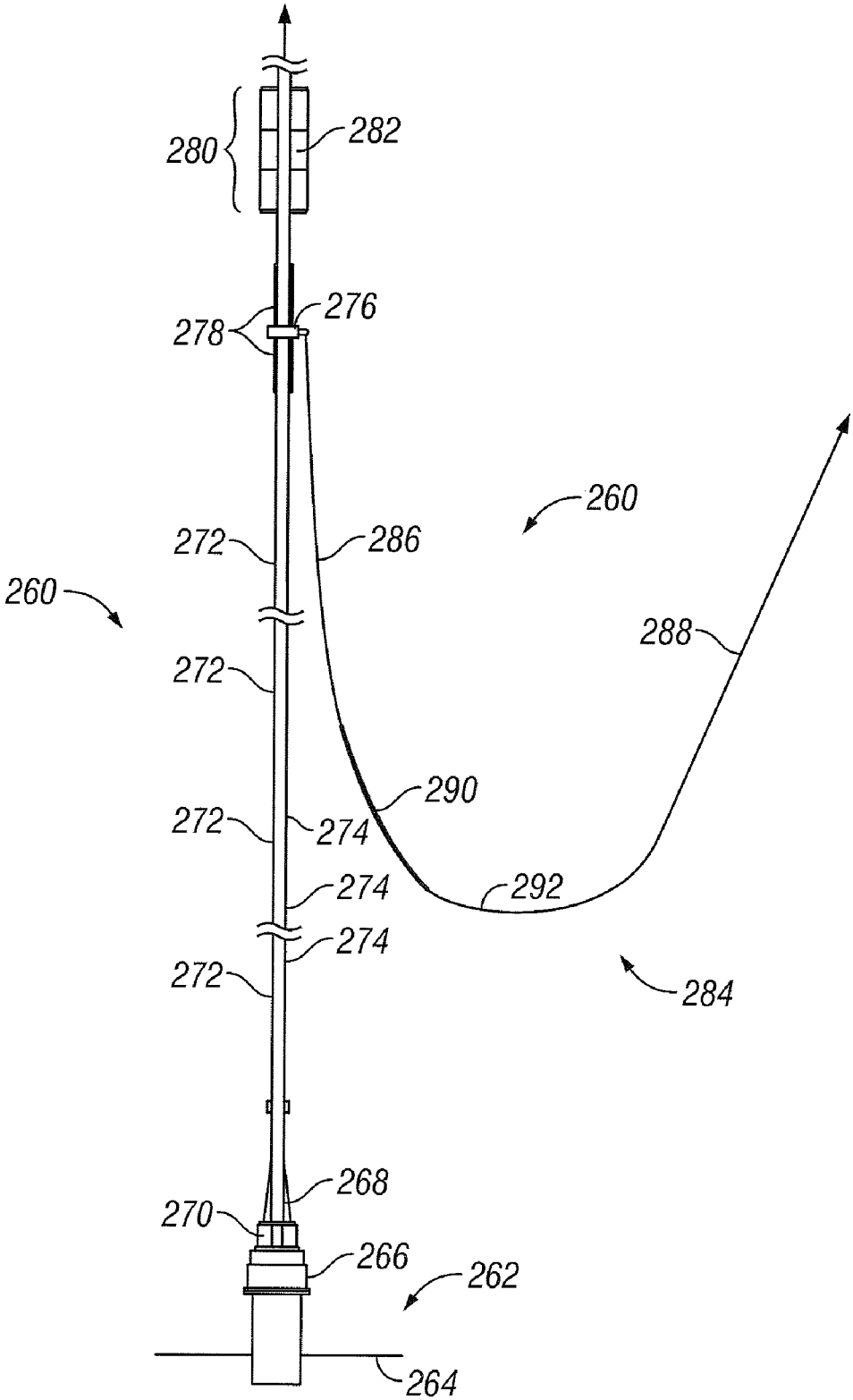
FIG. 23 is a schematic side view drawing showing components of a ballast installation chain in accordance with an embodiment of the present invention.

Referring now to FIG. 23, an installed variable tension riser assembly 260 is more clearly visible. Variable tension riser assembly 260 extends upward from a wellhead assembly 262. Wellhead assembly 262 extends from the mud line 264 on the sea floor and includes a tieback connector 266. Variable tension riser 260 can include a stress joint 268 at its lower end for connection to wellhead assembly 262. Optionally, a ballast weight 270 can be located at a distal end of stress joint 268 to assist in the seating of variable tension riser assembly 260 upon wellhead 262. Extending upward from stress joint 268, variable tension riser 260 can include a bottom region of slick pipe sections 272 connected together by pipe connections 274. Variable tension riser 260 can include a pad-eye connection point 276 where a tension line can be attached. Stress-relief subs 278 can be located above and below connection point 276 to prevent damage to variable tension riser assembly 260 when loads are applied. Furthermore, the lowermost buoyancy region 280 of variable tension riser assembly 260 can be located above connection point 276 and stress relief subs 278. Buoyancy region 280 can be constructed as a string of pipe joints with attached buoy members 282 known to one of skill in the art.

Extending from connection point 276, a ballast and tension line assembly 284 is attached. Ballast and tension line assembly 284 can include sections of synthetic line 286, 288, a main, heavy, ballast chain 290, and a fine-tuning, light, ballast chain 292. Synthetic line sections 286 can conveniently be constructed as a 6-inch diameter polyester rope, but can be of any style and type known to one of ordinary skill in the art. Heavy main ballast chain 290 is conveniently constructed as a 6-inch stud-link chain approximately 650 feet long and weighing about 180,000 pounds in water. Fine-tuning ballast chain 292 is conveniently constructed as a 3-inch stud-link chain approximately 500 feet long and weighing 40,000 pounds in water.

Figure 24:
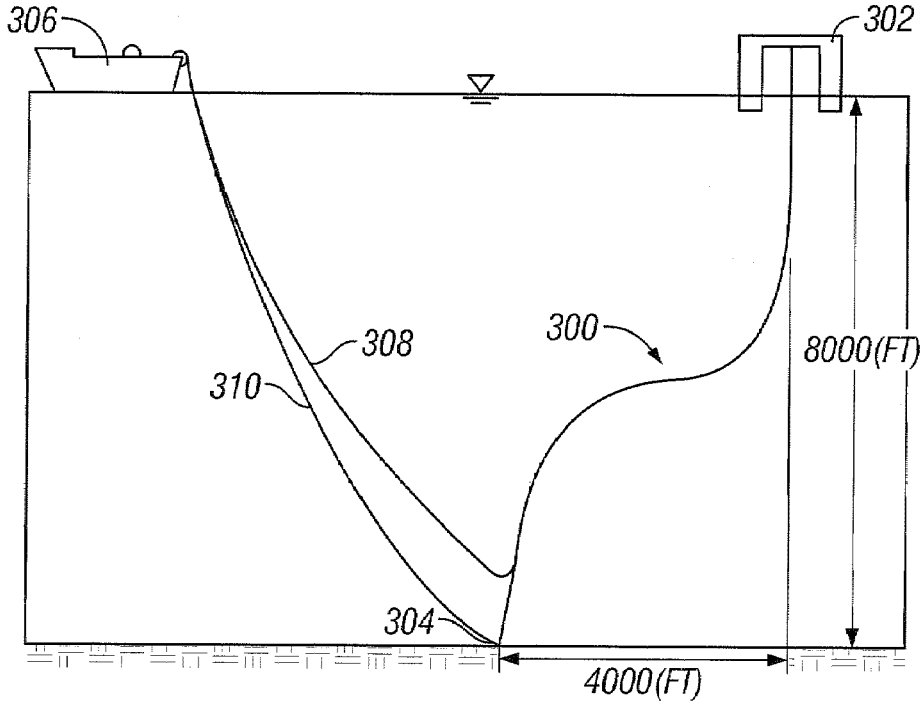
FIG. 24 is a schematic side view drawing illustrating the deployment of ballast line and control line as part of a variable tension riser installation procedure in accordance with an embodiment of the present invention.

Referring now to FIG. 24, a variable tension riser 300 extends from a floating platform 302 to a subsea wellhead 304. A workboat 306 assists in the installation of riser 300 by supplying a pair of tension and control lines 308, 310. Weight control line 308 typically counteracts any buoyancy in variable tension riser 300 while it is deployed from floating platform 302 by employing rope line and various ballast chains as described above. Angle control line 310 helps manipulate the connection end of variable tension riser 300 so that it will properly mate up with a tieback connector (not shown) of wellhead 304. Optionally, angle control line 310 may be supplemented or replaced by one or more subsea ROVs to help guide variable tension riser 300.

Furthermore, examples for various depths and geometries are apparent in FIG. 24. While the numbers shown are representative of one embodiment of the present invention, they are by no means limiting. Deeper and shallower depths for variable tension riser 300 are feasible and the specific geometries for each installation are unique and depend on a variety of factors. Particularly, wellhead 304 is shown at a depth of 8,000 feet of water and displaced 4,000 feet away from platform 302. For this particular installation, weight control line 308 is located above a distal end of variable tension riser 300. While the absolute limits of embodiments of the present invention are not known, it is expected that water depths from 5,000 feet to 10,000 feet are easily feasible with wellhead deviations within one half of the vertical depth. Therefore, for a 10,000 foot deep cluster of subsea wellheads, embodiments of the present invention can be used to tie back multiple subsea wellheads to a single floating platform, provided that the farthest wellhead from the floating platform is 5,000 feet or closer.

Figure 25:
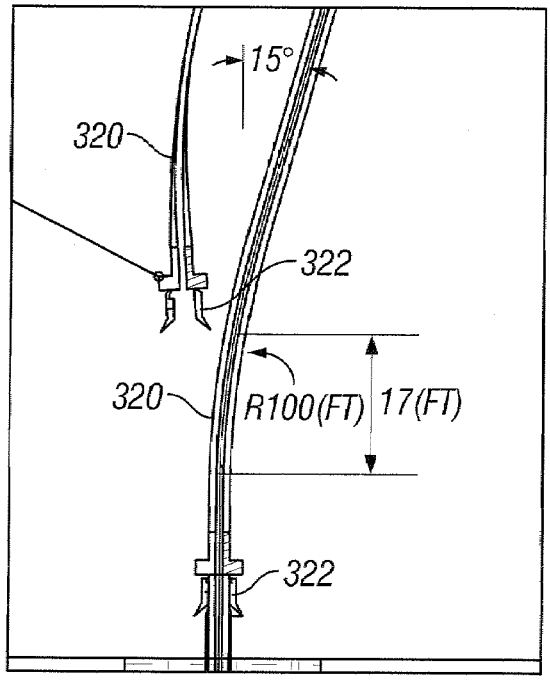
FIG. 25 is a schematic side view drawing of a variable tension riser having a tapered stress joint mounted there upon in accordance with an embodiment of the present invention.
Figure 26:
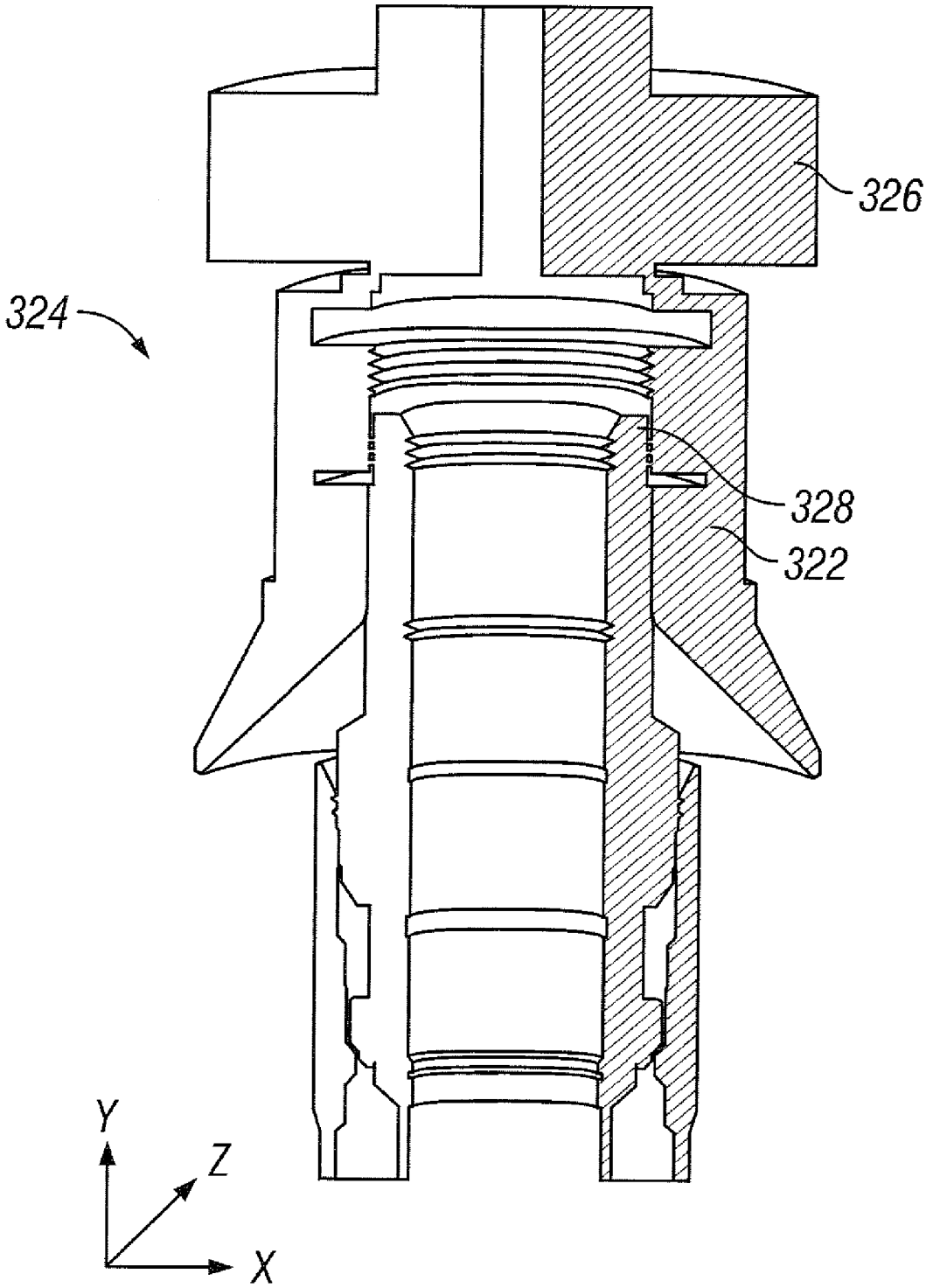
FIG. 26 is a section view drawing of a subsea wellhead having a wellhead connector and a tapered stress joint in accordance with an embodiment of the present invention.

Referring collectively to FIGS. 25 and 26, a tapered stress joint 320 and a wellhead connector 322 for a variable tension riser are shown. Tapered stress joint 320 can be constructed to allow bending and deflection of a variable tension riser. Depending on wellhead location, tapered stress joint 320 can be constructed as a curved member, thereby further reducing the amount of stress experienced by wellhead connector 322 when variable tension riser assembly is displaced. FIG. 25 details a tapered stress joint 322 that is curved at a slight radius of approximately 100 feet at a distance approximately 17 feet above a wellhead connector 322. This slight radius, shown for example only and not intended to limit any embodiment of the present invention to a particular geometry, is used so that stress may be removed from wellhead connector 322 while still allowing the passage of relatively rigid tools and servicing equipment. Following the curved radius portion, the remainder of the variable tension riser assembly is shown deflected away from wellhead at a representative angle of approximately 15° from vertical. Referring now to FIG. 26, wellhead assembly 324 includes wellhead connector 322 disposed at a distal end 326 of the variable tension riser and a wellhead tieback connector 328. Wellhead connector 322 is designed to engage wellhead tieback connector 328 to form a rigid, sealed connection to facilitate communication (hydraulic, electrical, mechanical, etc.) between the variable tension riser and the wellhead. While one specific design for wellhead assembly 324 is shown, it will be understood by one skilled in the art that various future and current designs for wellhead assembly 324 and its components can be used without departing from the spirit of the embodiments of the present invention.

Figure 27:
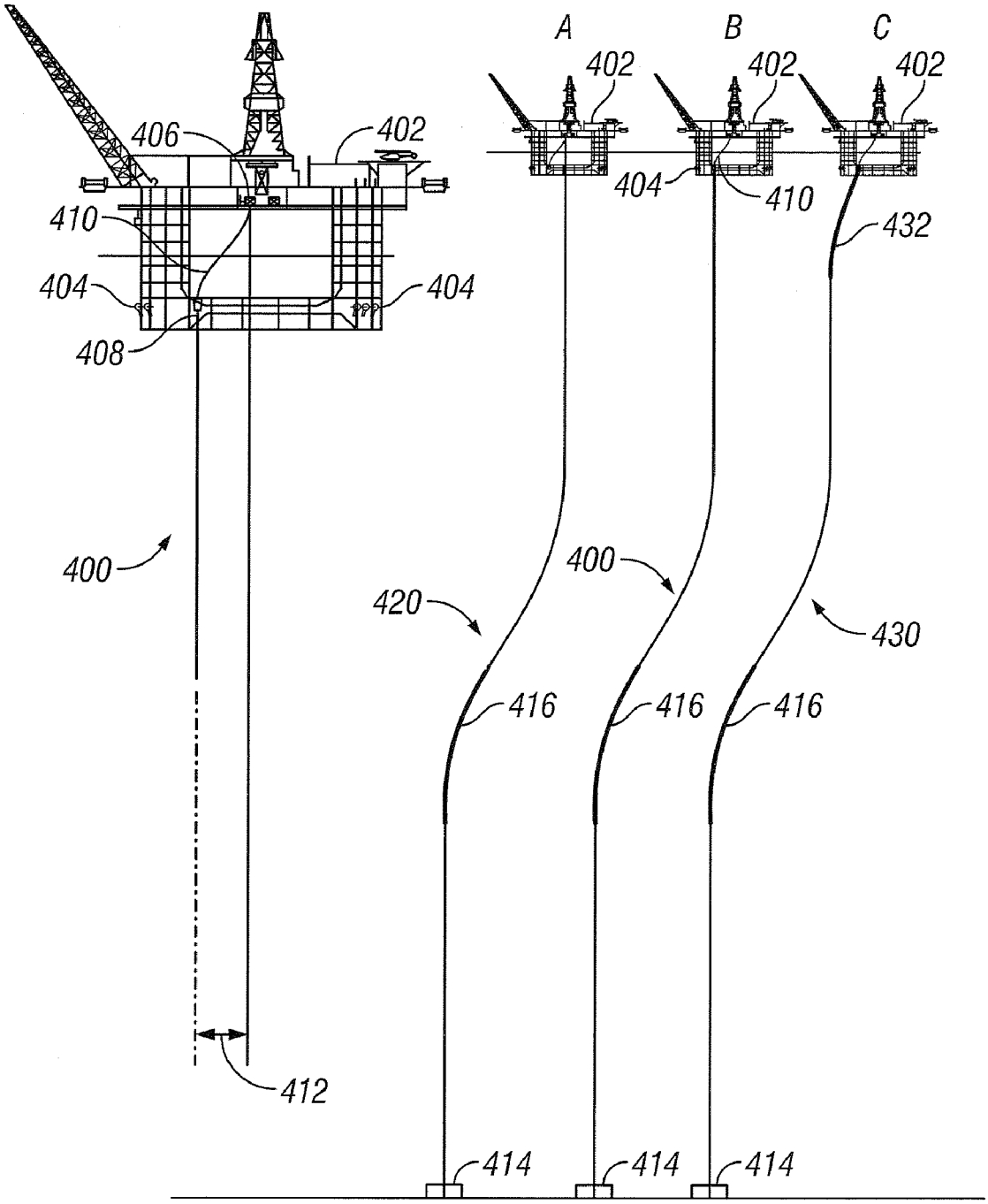
FIG. 27 is a schematic side view drawing of a floating platform with a variable tension riser extending therefrom in accordance with an embodiment of the present invention.

Referring to FIG. 27, variable tension riser assembly 400 extends from floating platform 402 to a subsea wellhead (not shown). Floating platform 402 can include flotation pontoons 404 and a dry tree 406. Dry tree 406 includes the valves and controls necessary to control and service the subsea wellhead at the end of variable tension riser 400. Variable tension riser 400 differs from other illustrated embodiments of the present invention in that the uppermost end 408 of variable tension riser 400 is terminated at pontoon 404 of platform 402 rather than at dry tree 406 itself. Variable tension riser 400 thus can include a rigid curved spool connection 410 to connect dry tree 404 with the upper end of variable tension riser 400 terminated at pontoon 406. The benefit of terminating riser 400 at pontoon 406 is that an offset 412 from the center of platform 402 can be created. Offset 412 is beneficial in that it helps mitigate the potential for riser-to-riser contact when multiple risers are tied back to the floating production facility.

Referring briefly to FIG. 27B, variable tension riser assembly 400 is visible along its entire length from platform 402 to wellhead 414. Variable tension riser 400 includes an s-curve region 416 and is terminated at pontoon 404 with spool connection 410 to dry tree 406. In contrast, FIG. 27A shows a variable tension riser assembly 420 of previous embodiments, whereby riser 420 extends from wellhead 414 to the dry tree without the use of a termination at pontoon 404 or a spool connection 410. Furthermore, another alternative variable tension riser 430 is shown in FIG. 27C wherein variable riser 430 terminates at pontoon 404 with a spool connection 410 making the connection to dry tree 406. However, variable tension riser 430 includes an additional curved section 432 extending from pontoon 404 to just below platform 402. This additional curved section 432 helps reduce any stress that may result from terminating variable tension riser 430 at pontoon 404 of platform 402.

Figure 28:
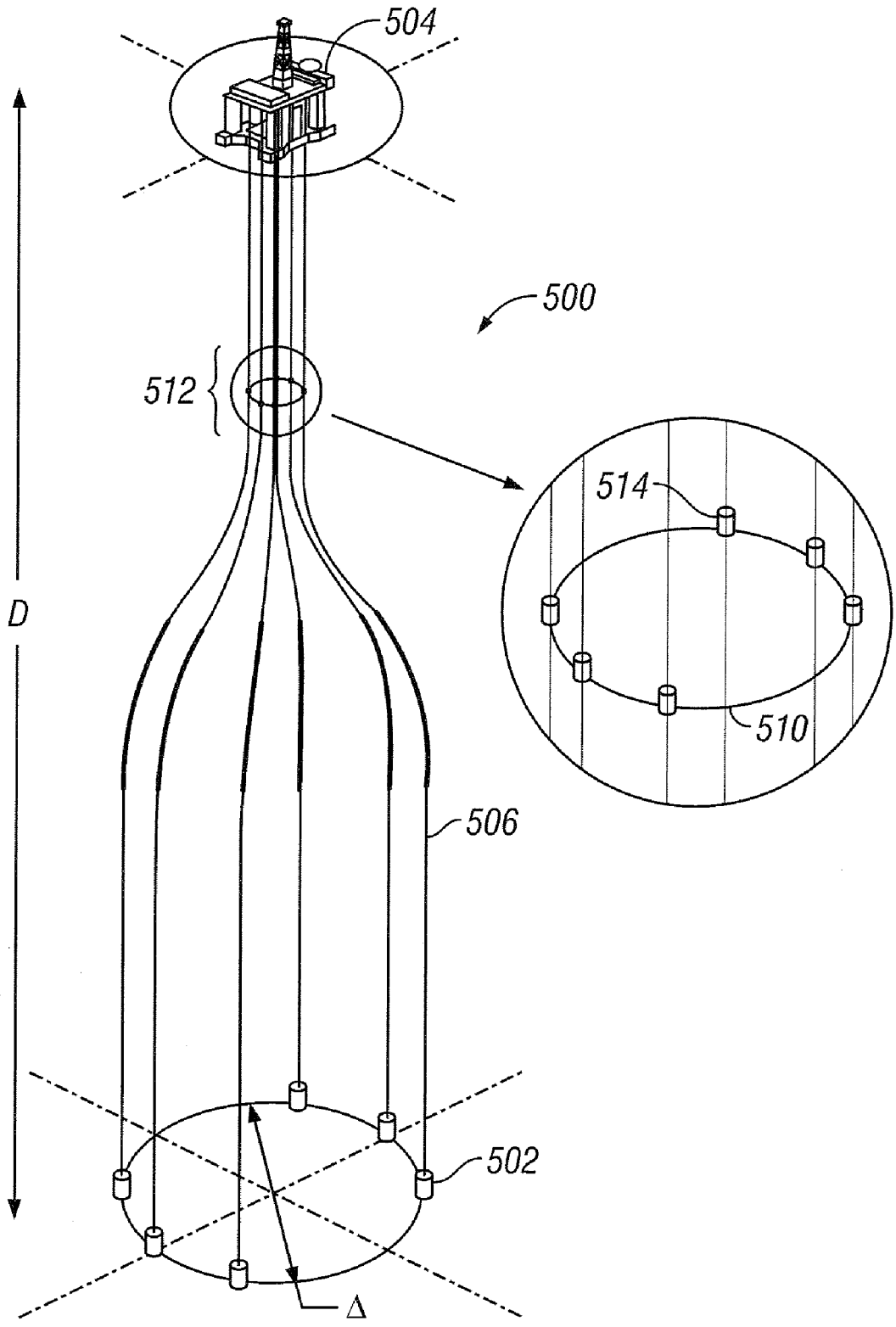
FIG. 28 is a schematic side view drawing of a floating platform with a plurality of variable tension risers interconnected at one location in accordance with an embodiment of the present invention.

Referring to FIG. 28, an alternative subsea well management system 500 can include a plurality of subsea wellheads 502 connected to a floating platform 504 through a plurality of variable tension risers 506 across a water depth D. Variable tension risers 506 can include neutral buoyancy regions 508. Wellheads 502 are located within a grouping characterized by diameter Δ. However, well management system 500 also includes a spacer ring assembly 510 located at a lower end of the upper slick pipe region 512 of variable tension risers 506. While shown schematically as a circular ring, spacer ring assembly 510 can be constructed as any rigid geometry or shape design as desired and as construction permits. The spacer ring can include axial journals 514 connecting each variable tension riser 506 to ring 510. Axial journals 514 operate to allow relative axial movement between risers 506 and ring 510. Using spacer ring 510, some movement and compliance of risers 506 is permitted while still maintaining radial spacing of each riser 506. The goal of spacer ring 510 is to maintain clearance between variable tension risers 506 during all anticipated loading and turbulence conditions.

Figure 29:
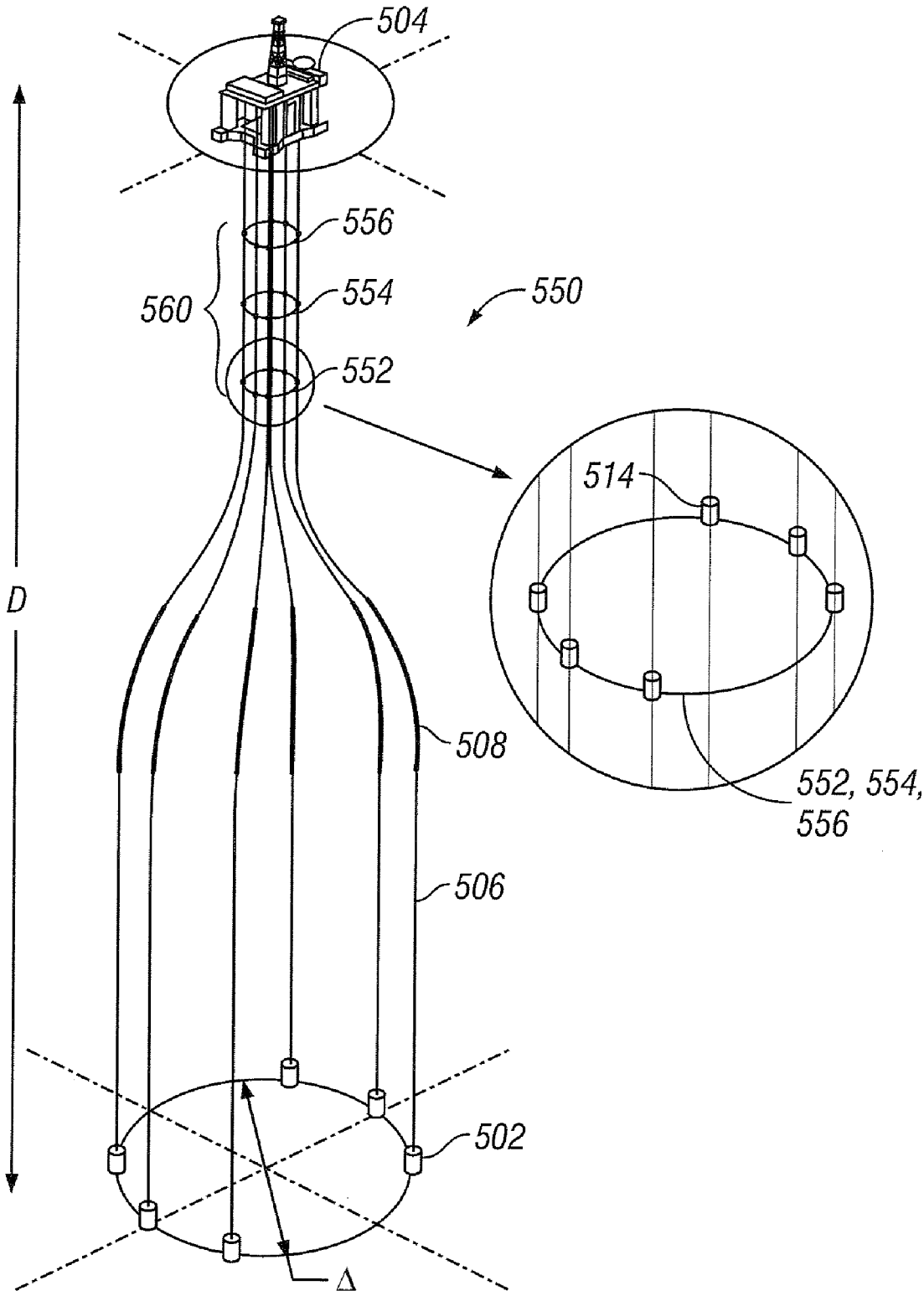
FIG. 29 is a schematic side view drawing of a floating platform with a plurality of variable tension risers interconnected at multiple locations in accordance with an embodiment of the present invention.

Referring briefly to FIG. 29, another alternative embodiment for a subsea well management system 550 is shown. Like management system 500 of FIG. 28, management system 550 of FIG. 29 includes a plurality of spacer rings 552, 554, 556 to maintain spacing between adjacent variable tension risers 506. This arrangement 550 is designed to maintain the spacing of risers 506 across a longer portion 560 of their length.

Figure 30:
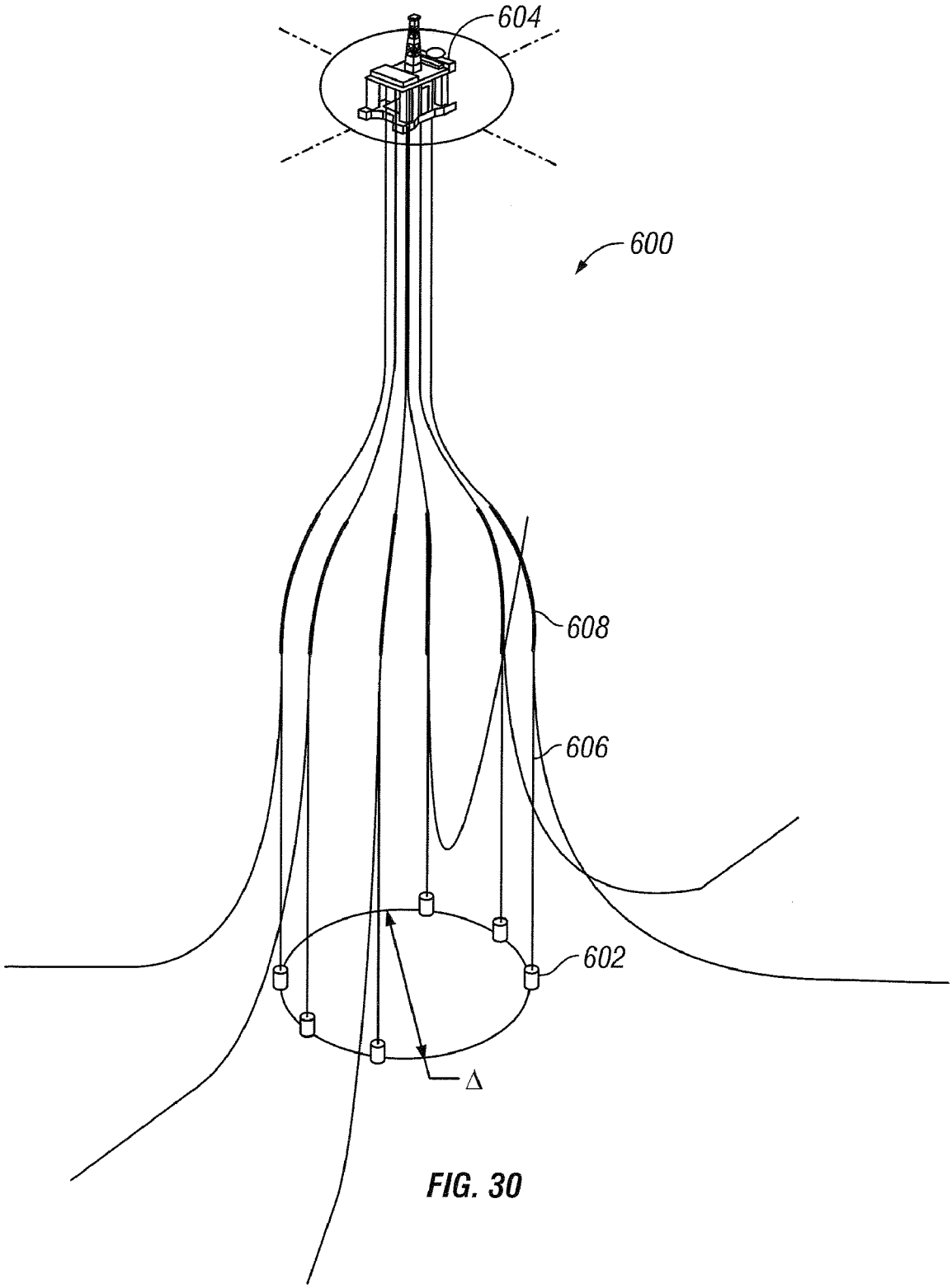
FIG. 30 is a schematic side view drawing of a floating platform with a plurality of variable tension risers including supplemental anchor lines in accordance with an embodiment of the present invention.

Referring now to FIG. 30, another alternative embodiment for a subsea well management system 600 is shown. Subsea well management system 600 can include a plurality of variable tension risers 606 extending from a group A of subsea wellheads 602 to a floating platform 604. Variable tension risers 606 can include neutral buoyancy regions 608 to form an s-curve to make variable tension risers 606 more compliant along their length. Subsea well management system 600 further includes a plurality of anchor lines 610 extending from each variable tension riser 606 to the sea floor. Anchor lines 610 are intended to maintain clearance between individual risers 606 during all anticipated loading conditions. Anchor lines 610 reduce horizontal loading on wellheads 602 and can enable larger diameter Δ groupings between wellheads 602.

Another embodiment of the present invention could include, for a near-field well offset scenario, terminating variable tension risers at support springs on the deck of a floating platform or production facility. Therefore, tension would not be applied to the risers directly other than to support the direct loads from the hanging of the risers themselves. The deck spring supports would be designed to reduce wave frequency loading on the variable tension risers that result from vertical motions of the production vessel or floating platform experiencing wave action.

Figure 31:
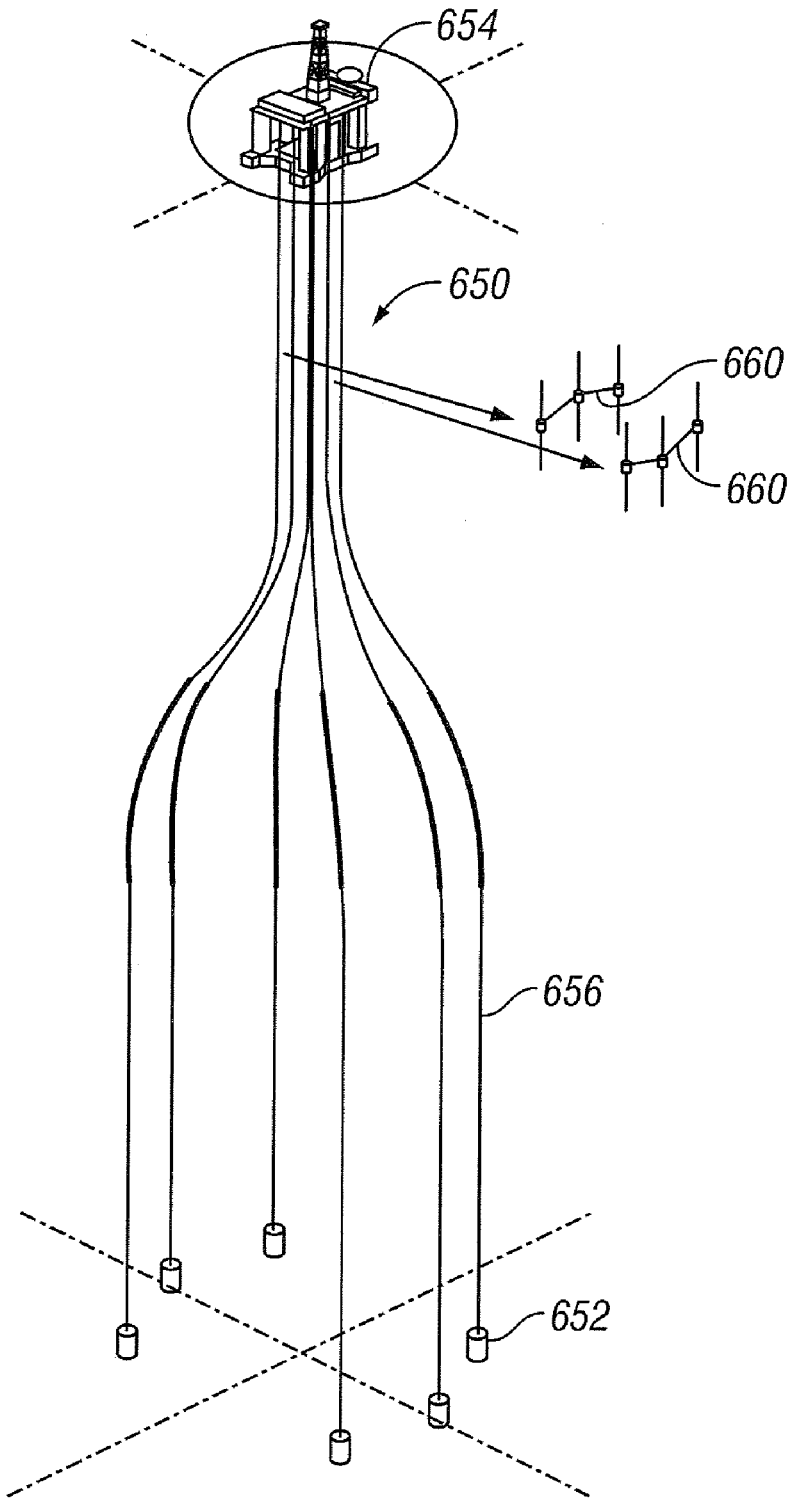
FIG. 31 is a schematic side view drawing of a floating platform with a plurality of variable tension risers including linkages to adjacent variable tension risers.

Referring to FIG. 31, another alternative embodiment for a subsea well management system 650 is shown. Subsea well management system 650 can include a plurality of variable tension risers 656 extending from a plurality of subsea wellheads 652 to a floating platform 654. Linking members 660 are shown linking adjacent variable tension risers 656 to one another to maintain spacing therebetween and to prevent deflection from anticipated loading conditions. Linking members 650 can be flexible or rigid.

Figure 32:
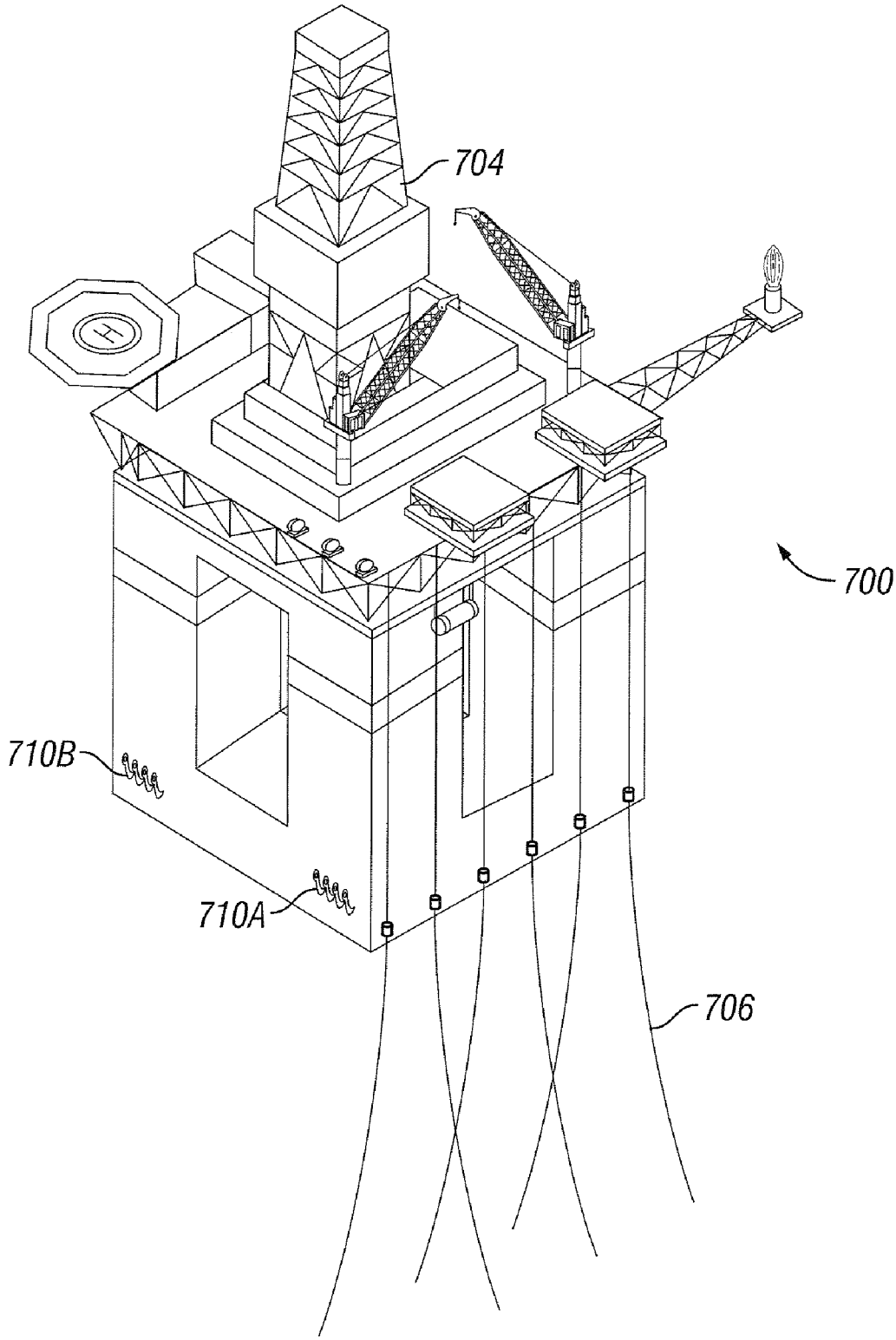
FIG. 32 is a schematic side view drawing of a floating platform with a plurality of variable tension risers extending from a single side thereof.

Referring to FIG. 32, another alternative embodiment for a subsea well management system 700 is shown. Subsea wellhead management system 700 can include a plurality of variable tension risers 706 extending from subsea wellheads (not shown) to a floating platform 704. Floating platform 704 includes pontoon assemblies 710A, 710B from which all variable tension risers 706 extend. As shown in FIG. 32, all variable tension risers 706 can extend from a single pontoon assembly 710A on one side of floating platform 704. This configuration may prove to be beneficial in that it allows a less cluttered layout for floating platform 704 and that floating platform can be configured to minimize motions from anticipated loading conditions at a single end. Furthermore, with the risers 706 terminated at the pontoon 710A level, the need for water ballast to be carried by the floating platform 704 can be reduced.

Figure 33:
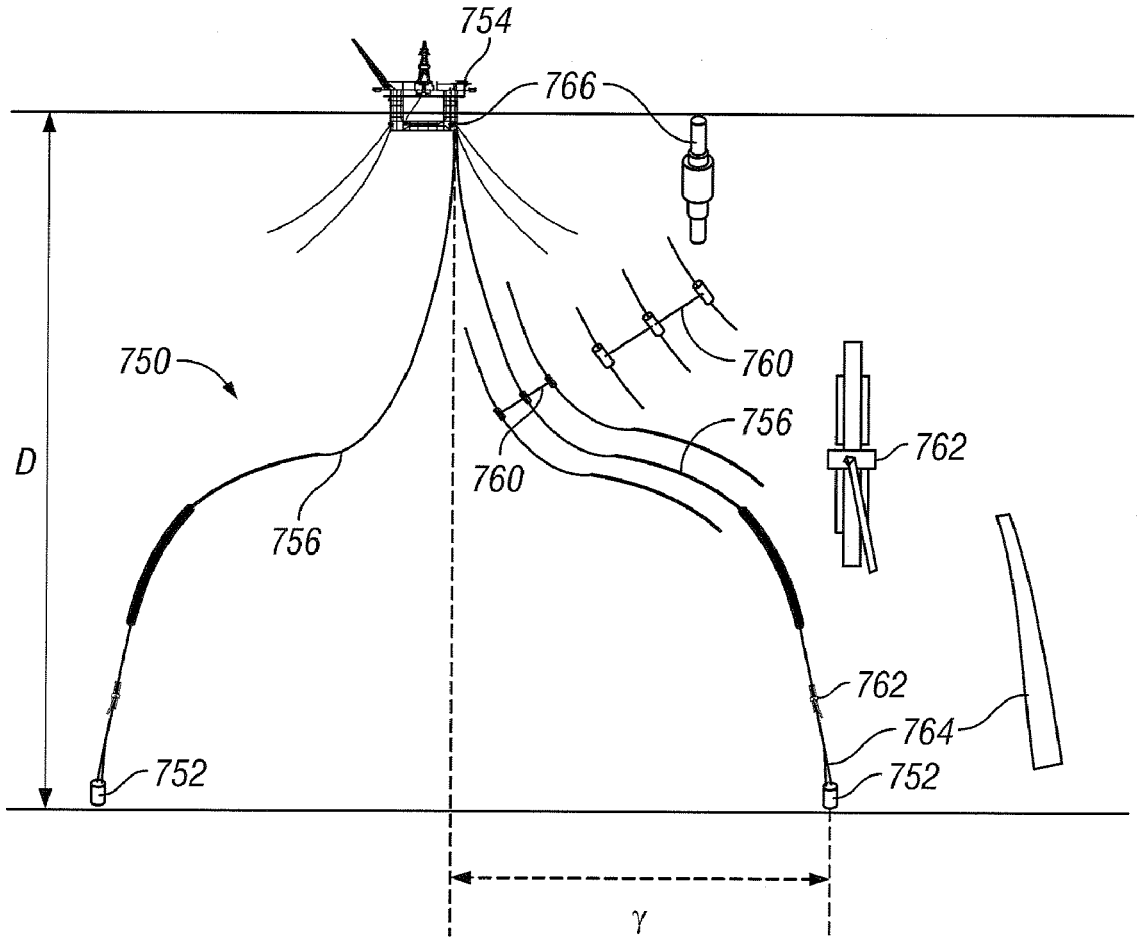
FIG. 33 is a schematic side view drawing of a floating platform with a plurality of variable tension risers extending therefrom in accordance with an embodiment of the present invention.

Referring to FIG. 33, a combined embodiment of a subsea well management system 750 is shown. System 750 includes a plurality of variable tension risers 756 connecting subsea wellheads 752 to a floating platform 754. Subsea wellhead 752 is shown located at a depth D and at a lateral offset γ from platform 754. Depth D can range from 1,000 to 15,000 feet or more, desirably from 4,000 to 10,000 feet of water depth, with offset γ typically being less than or equal to one-half the depth D. Furthermore, optional linkage 760, attachment points 762, and stress joints 764, 766 are shown. Linkage or weighted rope 760 is optionally used to connect adjacent variable tension risers 756 together to prevent excessive displacement. Attachment point 762 is desirably used to attach ballast lines and chains (e.g. 218, 228, 230 of FIGS. 7–21) to variable tension riser 756 during installation. Stress joints, 764, 766 are optionally installed at proximate and distal ends of variable tension riser 756 to reduce the magnitude of bending stresses on riser 756. Lower stress joint 756 can be a curved and tapered design to permit greater flexibility in the layout of wellheads 752 on the sea floor and upper stress joint 766 can be of any type, including keel or curved types, known in the art to improve the behavior of system 750.

Figure 34:
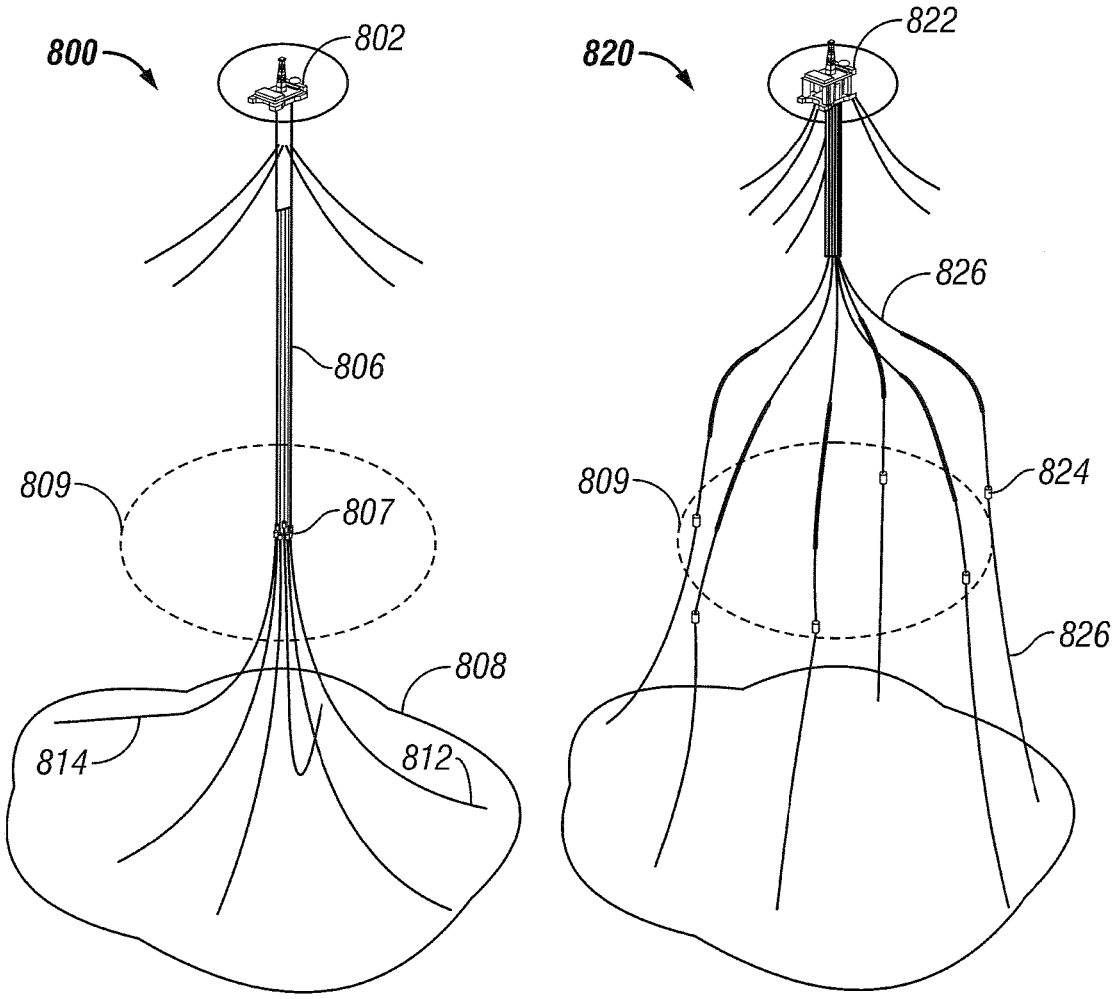
FIG. 34 is a schematic isometric view drawing of floating platforms depicting benefits of embodiments of the present invention over prior art systems.

Referring finally to FIG. 34, a comparison of a traditional dry tree well management system 800 with an improved well management system in accordance with the present invention 820 is shown. Traditional well management system 800 required the deployment of a more stable positioned platform like the tension leg platform (TLP), or the SPAR platform 802 shown. Risers 806 extending therefrom to subsea wellheads 807 at the mudline 809 above a reservoir 808 to be explored or produced were closely bundled together. This generally required completion in the reservoir 808 via slant wells 812 and/or horizontal or partially horizontal wells 814, which are less directionally accurate, more expensive, and not always feasible depending on formation characteristics.

In contrast, improved well management system 820 uses variable tension risers 826 to investigate reservoir 808, thereby allowing a more scattered placement of wellheads 824 therein. Furthermore, because system 820 is less constrictive on the movement of risers 826, less rigidly positioned platforms 822 can be used. Particularly, semi-submersible, and other floating production platforms that are not capable of the positional stability of tension leg and SPAR platforms can be used and a wider placement of wellheads 824 within reservoir 808 is possible. This permits the wells 826 to be drilled more closely to vertical with improved directional accuracy and lower cost. The benefit is particularly significant compared to shallow zone type wells 814 previously completed via partially horizontal drilling.

Numerous embodiments and alternatives thereof have been disclosed. While the above disclosure includes the best mode belief in carrying out the invention as contemplated by the inventors, not all possible alternatives have been disclosed. For that reason, the scope and limitation of the present invention is not to be restricted to the above disclosure, but is instead to be defined and construed by the appended claims

The invention claimed is:

1. An apparatus to communicate with a plurality of subsea wells located at a depth from the surface of a body of water, the apparatus comprising:

a floating platform including a dry tree apparatus configured to communicate with and service the subsea wells; and a plurality of variable tension risers comprising a negatively buoyant region, a positively buoyant region, and a neutrally buoyant region between the negatively and positively buoyant regions, and configured to extend from the wells to the floating platform; and a spacer ring making a connection between the neutral buoyancy regions and the negatively buoyant regions of the variable tension risers to restrict relative lateral movement and allow axial movement of the variable tension risers;

wherein the negatively buoyant region hangs below the floating platform and exhibits positive tension, the neutrally buoyant region is located between the negatively and positively buoyant regions and characterized by a curved geometry configured to traverse a lateral offset of at least 300 feet between the floating platform and the subsea well, and the positively buoyant region is positioned above the subsea well and exhibits positive tension.

2. The apparatus of claim 1 wherein the depth of water is greater than 4,000 feet.

3. The apparatus of claim 1 wherein the depth of water is less than 15,000 feet.

4. The apparatus of claim 1 wherein the depth of water is less than 10,000 feet.

5. The apparatus of claim 1 wherein the plurality of subsea wells is characterized by a maximum offset less than or equal to one half the depth from the surface of the body of water.

6. The apparatus of claim 1 wherein the plurality of subsea wells is characterized by a maximum offset greater than or equal to one tenth the depth from the surface of the body of water.

7. The apparatus of claim 1 wherein the plurality of subsea wells comprise vertically drilled wells and are free of slant and horizontally or partially horizontally drilled wells.

8. The apparatus of claim 1 wherein the floating platform is selected from spar platforms, tension leg platforms, submersible platforms, semi-submersible platforms, well intervention platforms, and drillships.

9. The apparatus of claim 1 wherein said floating platform is a dedicated floating production facility.

10. The apparatus of claim 1 wherein the variable tension risers terminate at the dry tree on the floating platform.

11. The apparatus of claim 1 wherein the variable tension risers terminate at a distal end of the floating platform.

12. The apparatus of claim 11 wherein the variable tension risers terminate at a pontoon structure of the floating platform.

13. The apparatus of claim 12 wherein the variable tension risers terminate at the pontoon structure on a single side of the floating platform.

14. The apparatus of claim 12 comprising spool connections connecting the variable tension risers at the pontoon structure to the dry tree.

15. An apparatus to communicate with a plurality of subsea wells located at a depth from the surface of a body of water, the apparatus comprising:

a floating platform including a dry tree apparatus configured to communicate with and service the subsea wells; and a plurality of variable tension risers comprising a negatively buoyant region, a positively buoyant region, and a neutrally buoyant region between the negatively and positively buoyant regions, and concluded to extend from the wells to the floating platform, wherein the variable tension risers terminate at a pontoon structure of the floating platform, wherein the variable tension risers include second neutral buoyancy regions proximate to the distal end of the floating platform; and spool connections connecting the variable tension risers at the pontoon structure to the dry tree;

wherein the negatively buoyant region hangs below the floating platform and exhibits positive tension, the neutrally buoyant region is located between the negatively and positively buoyant regions and characterized by a curved geometry configured to traverse a lateral offset of at least 300 feet between the floating platform and the subsea well, and the positively buoyant region is positioned above the subsea well and exhibits positive tension.

16. The apparatus of claim 1 wherein the variable tension risers include a rope and ballast line attachment point.

17. The apparatus of claim 1 wherein the variable tension risers include a stress joint proximate to a connection with the subsea well.

18. An apparatus to communicate with a plurality of subsea wells located at a depth from the surface of a body of water, the apparatus comprising:

a floating platform including a dry tree apparatus configured to communicate with and service the subsea wells; and a plurality of variable tension risers comprising a negatively buoyant region, a positively buoyant region, and a neutrally buoyant region between the negatively and positively buoyant regions, and configured to extend from the wells to the floating platform, wherein the variable tension risers include a curved stress joint proximate to a connection with the subsea well;

wherein the negatively buoyant region hangs below the floating platform and exhibits positive tension, the neutrally buoyant region is located between the negatively and positively buoyant regions and characterized by a curved geometry configured to traverse a lateral offset of at least 300 feet between the floating platform and the subsea well, and the positively buoyant region is positioned above the subsea well and exhibits positive tension.

19. The apparatus of claim 1 wherein the variable tension risers include a stress joint proximate to a distal end of the floating platform.

20. The apparatus of claim 1 further comprising anchor lines connecting the variable tension risers to a seafloor mooring to restrict movement of the variable tension risers.

21. The apparatus of claim 1 wherein the variable tension risers comprise tubing risers, single casing risers, or dual casing risers.

22. The apparatus of claim 21 wherein the variable tension risers further include control lines.

23. The apparatus of claim 1 wherein the variable tension risers include a linking mechanism to link at least two variable tension risers together.

24. The apparatus of claim 23 wherein the linking mechanism links adjacent variable tension risers together in the first tension region.

25. The apparatus of claim 23 wherein the linking mechanism comprises rope.

26. An apparatus to communicate with a plurality of subsea wells located at a depth from the surface of a body of water, the apparatus comprising:

a floating platform including a dry tree apparatus configured to communicate with and service the subsea wells; and a plurality of variable tension risers comprising a negatively buoyant region, a positively buoyant region, and a neutrally buoyant region between the negatively and positively buoyant regions, and configured to extend from the wells to the floating platform, wherein the variable tension risers include a curved stress joint proximate to a distal end of the floating platform;

wherein the negatively buoyant region hangs below the floating platform and exhibits positive tension, the neutrally buoyant region is located between the negatively and positively buoyant regions and characterized by a curved geometry configured to traverse a lateral offset of at least 300 feet between the floating platform and the subsea well, and the positively buoyant region is positioned above the subsea well and exhibits positive tension.

27. An apparatus to communicate with a plurality of subsea wells located at a depth from the surface of a body of water, the apparatus comprising:

a floating platform including a dry tree apparatus configured to communicate with and service the subsea wells; and a plurality of variable tension risers comprising a negatively buoyant region, a positively buoyant region, and a neutrally buoyant region between the negatively and positively buoyant regions, and configured to extend from the wells to the floating platform, wherein the variable tension risers include a second negatively buoyant region between the positively buoyant region and the subsea well with positive tension in the riser proximate the subsea wells;

wherein the negatively buoyant region hangs below the floating platform and exhibits positive tension, the neutrally buoyant region is located between the negatively and positively buoyant regions and characterized by a curved geometry configured to traverse a lateral offset of at least 300 feet between the floating platform and the subsea well, and the positively buoyant region is positioned above the subsea well and exhibits positive tension.

28. A variable tension riser to connect a subsea wellhead to a floating platform at a lateral offset of at least 300 feet, comprising:

a first negatively buoyant region, a neutrally buoyant curved region, a positively buoyant region, and a second negatively buoyant region;

wherein the first negatively buoyant region hangs below the floating platform and exhibiting positive tension;

wherein the neutrally buoyant curved region is located between the first and second negatively buoyant regions;

wherein the positively buoyant region is positioned between the curved region and the second negatively buoyant region to create positive tension in the second negatively buoyant region;

wherein the second negatively buoyant region is positioned above and connected to the subsea wellhead; and a communications conduit to allow communications from the floating platform to a wellbore of the subsea wellhead.

29. The variable tension riser of claim 28 wherein the curved region traverses the lateral offset between the subsea wellhead and the floating platform.

30. The variable tension riser of claim 28 wherein the subsea wellhead is greater than 4,000 feet below the floating platform.

31. The variable tension riser of claim 28 wherein the subsea wellhead is less than 15,000 feet below the floating platform.

32. The variable tension riser of claim 28 wherein the subsea wellhead is less than 10,000 feet below the floating platform.

33. The variable tension riser of claim 28 wherein the lateral offset is less than or equal to one half of a depth of the subsea wellhead below the floating platform and more than on tenth of the depth.

34. The variable tension riser of claim 28 further comprising a second neutral buoyancy region proximate to the floating platform.

35. The variable tension riser of claim 28 further comprising a stress joint proximate to the subsea wellhead.

36. The variable tension riser of claim 28 further comprising an anchor line extending to a seafloor mooring to restrict movement of the variable tension riser.

37. The variable tension riser of claim 28 wherein the floating platform is a semi-submersible platform.

38. The variable tension riser of claim 28 further including a linking member connecting the variable tension riser to a second variable tension riser.

39. The variable tension riser of claim 28 wherein the positively buoyant region positively tensions the riser at the subsea wellhead connection.

* * * * *